US009365384B2

(12) United States Patent
Thompson et al.

(10) Patent No.: US 9,365,384 B2
(45) Date of Patent: Jun. 14, 2016

(54) HAND HELD MASKING SHEET MATERIAL DISPENSER

(71) Applicant: 3M INNOVATIVE PROPERTIES COMPANY, St. Paul, MN (US)

(72) Inventors: Craig D. Thompson, Inver Grove Heights, MN (US); Jacob P. Vanderheyden, St. Paul, MN (US); Christian R. Trifilio, St. Paul, MN (US); Christopher E. Somero, Maple Grove, MN (US); Jeffrey B. Waffensmith, North Oaks, MN (US); Christopher J. Herman, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 3 days.

(21) Appl. No.: 14/594,279

(22) Filed: Jan. 12, 2015

(65) Prior Publication Data

US 2015/0203320 A1 Jul. 23, 2015

Related U.S. Application Data

(60) Provisional application No. 61/929,884, filed on Jan. 21, 2014.

(51) Int. Cl.
*B65H 35/07* (2006.01)
*B65H 35/00* (2006.01)

(52) U.S. Cl.
CPC ..... *B65H 35/004* (2013.01); *B65H 35/0026* (2013.01); *B65H 35/0033* (2013.01); *Y10T 225/10* (2015.04); *Y10T 225/232* (2015.04); *Y10T 225/247* (2015.04)

(58) Field of Classification Search
CPC ..... B65H 35/0026; B65H 35/0033; B65H 35/004
See application file for complete search history.

(56) References Cited

U.S. PATENT DOCUMENTS

| | | | | |
|---|---|---|---|---|
| 3,871,940 | A * | 3/1975 | Antonioni | B05B 15/0456 156/353 |
| 3,950,214 | A | 4/1976 | Pool et al. | |
| 4,096,021 | A | 6/1978 | Pool et al. | |
| 4,425,182 | A * | 1/1984 | Jones | B05B 15/0456 156/527 |
| 4,783,016 | A | 11/1988 | Pool | |
| 4,906,322 | A | 3/1990 | Hollier | |
| 5,113,921 | A | 5/1992 | Pool | |

(Continued)

OTHER PUBLICATIONS

PCT International Search Report from PCT/US15/11590, mailed on Mar. 30, 2015, 2 pages.

*Primary Examiner* — Mark A Osele
(74) *Attorney, Agent, or Firm* — Sandra K. Nowak

(57) ABSTRACT

A hand held dispenser for dispensing sheet material from a roll. The dispenser includes a handle assembly, an elongated blade, and a support assembly. The handle assembly includes a hub rotatably mounted to a frame. The blade extends from the frame. The support assembly includes a bracket, a brace and a support hub. The bracket is attached to the blade apart from the frame and includes a guide track. The guide track provides first and second segments that combine to define a guide axis. A leading side of the brace is slidably mounted to the guide track along the guide axis. The support hub is rotatably mounted to a trailing side of the brace. In a locked state, the leading side is slidably disposed over the track first segment and cannot rotate. In an unlocked state, the leading side is over the track second segment and is allowed to rotate.

19 Claims, 20 Drawing Sheets

(56) References Cited

U.S. PATENT DOCUMENTS

| | | | | |
|---|---|---|---|---|
| 5,445,703 | A | 8/1995 | Steeves et al. | |
| 5,628,866 | A | 5/1997 | Pool | |
| 5,667,626 | A | 9/1997 | Cayford et al. | |
| 5,683,542 | A | 11/1997 | Poole | |
| 5,775,632 | A * | 7/1998 | Huerta | B65H 16/005 242/597.6 |
| 6,497,263 | B1 | 12/2002 | Pitzen | |
| 7,819,162 | B2 | 10/2010 | Pool | |
| 7,921,896 | B2 | 4/2011 | Anderson | |
| 2003/0209122 | A1 | 11/2003 | Hguyen | |
| 2008/0156444 | A1 * | 7/2008 | Pitzen | B32B 3/06 156/510 |
| 2009/0324879 | A1 * | 12/2009 | Anderson | B65H 35/004 428/121 |
| 2014/0090785 | A1 * | 4/2014 | Nguyen | B65H 35/004 156/516 |

* cited by examiner

HAND HELD MASKING SHEET MATERIAL DISPENSER

BACKGROUND

The present disclosure relates to dispensers for dispensing lengths of sheet material from a roll. More particularly, it relates to hand held dispersers capable of dispensing and cutting sheet material, such as a masking film, from a roll in tandem with an adhesive tape.

Many painting, trimming or other surface finishing tasks greatly benefit from the temporary placement, prior to application of the finishing treatment, of a protective material over a portion of the surface at which the surface treatment effect is not desired. This approach is commonly referred to as "masking," and under circumstances where a relative large area of the surface is to be protected or masked, a well-accepted technique is to apply a sheet of masking material (e.g., plastic or paper) to the surface. The sheet is held in place by an appropriate adhesive tape. The masking sheet material and the adhesive tape are typically provided separate from one another, for example in separate rolls.

To simplify the task of simultaneously applying a length of sheet material and adhesive tape to a surface, hand held dispensers have been developed. These dispensers are sometimes referred to as masking machines or devices and generally include a handle frame to which two hubs are rotatably mounted. The first hub is adapted to receive a roll of masking sheet material, and the second hub is adapted to receive a roll of tape. Tape from that roll is guided by other components of the frame to a leading periphery of the roll of masking sheet material, bringing a side portion of the tape into adhered contact with a portion of the masking sheet material to form a composite masking sheet material having a portion of an adhesive side of the tape exposed. The exposed portion of the tape can then be adhered to the surface in question. An elongated blade is carried by the frame. Once a desired length of the composite masking sheet material has been dispensed and adhered to the surface, the handle frame is manipulated to sever the length from the rolls. One example of a highly regarded masking dispenser is available from 3M Company of St. Paul, Minn. under the trade name 3M™ Hand-Masker™ M3000 Dispenser.

A user can readily pull the composite masking sheet material formed at the periphery of the roll of masking sheet material from the dispenser by either holding the dispenser while pulling on the composite masking sheet material or by moving the dispenser away from the composite sheet material as it is adhered along a surface. The blade extends substantially parallel to the axes of the hubs to define a first side of a passageway through which the composite masking sheet material is pulled from the dispenser. The user can manually tension the composite masking sheet material as it is pulled from the dispenser (via the passageway), and then manipulate the handle, and thus the blade, transversely to force a cutting edge of the blade through the tensioned composite masking sheet material. Severing of the composite masking sheet material is effectuated in a progressive fashion, starting from an edge of the composite masking sheet material adjacent the handle and progressing toward an opposite end of the blade.

While well-accepted and highly viable, in some instances the cut edge formed by the dispenser may not be entirely straight (i.e., may not form a true right angle relative to the longitudinal edge of the composite masking sheet material). Due to the relatively high tension in the composite sheet material, the blade may deflect or flex slightly during the cutting motion. Thus, there may be some relative movement between the blade and the roll of masking sheet material as the material is progressively severed, possibly leading to an uneven cut edge. While the less-than-straight cut edge is easily accounted for or addressed by the user, some users have expressed a desire for straight cuts.

In light of the above, a need exists for a hand held dispenser for dispensing and cutting a length of sheet material from a roll of sheet material that more consistently effectuates a straight cut edge.

SUMMARY

Some aspects of the present disclosure are directed toward a hand held dispenser for dispensing lengths of sheet material from a roll of sheet material. The roll of sheet material includes opposing, first and second roll ends. The dispenser includes a handle assembly, an elongated blade, and a support assembly. The handle assembly includes a frame and a hub. The hub is configured to selectively receive the first roll end and is rotatably mounted to the frame such that the hub is rotatable about a hub axis. The blade is attached to and extends from the frame. The blade defines opposing, first and second blade ends, with the first blade end proximate the frame and the second blade end opposite the frame. The support assembly includes a bracket, a brace and a support hub. The bracket is attached to the blade apart from the frame and includes a guide track. The guide track provides first and second segments that combine to define a guide axis. The brace defines a leading side opposite a trailing side. The leading side is slidably mounted to the guide track such that the brace is slidable relative to the blade along the guide axis. The support hub is configured to selectively receive the second roll end and is rotatably mounted to the trailing side of the brace. With this construction, the dispenser is configured to provide a locked state and an unlocked state. In the locked state, the leading side of the brace is disposed over the first segment of the guide track and is prevented from rotating relative to the bracket. In the unlocked state, the leading side of the brace is over the second segment of the guide track and is allowed to rotate relative to the bracket.

The roll of sheet material can be coupled to the dispenser by maneuvering the brace to the unlocked state and rotating the brace (e.g., about the guide axis) to move the support hub away from the hub. The first end of the roll is then mounted on to the hub. The brace is then manipulated to the locked state, sliding the support hub into engagement with the second end of the roll. During use, the roll of sheet material is tied to both ends of the blade. When the dispenser is manipulated to cut a dispensed length of the sheet material, the roll will effectively move with any movement or deflection of the blade as the sheet material is progressively severed from the first end of the blade to the second end.

Other embodiments of the present disclosure are directed toward a support assembly for mounting or retrofitting to an existing dispenser. The support assembly can have the constructions described above, and is readily mounted to the blade of the existing dispenser. In other embodiments, the support assembly, the elongated blade and an optional guard are pre-assembled and then mounted or retrofitted to the handle assembly of an existing dispenser.

DETAILED DESCRIPTION

Figure 1A:
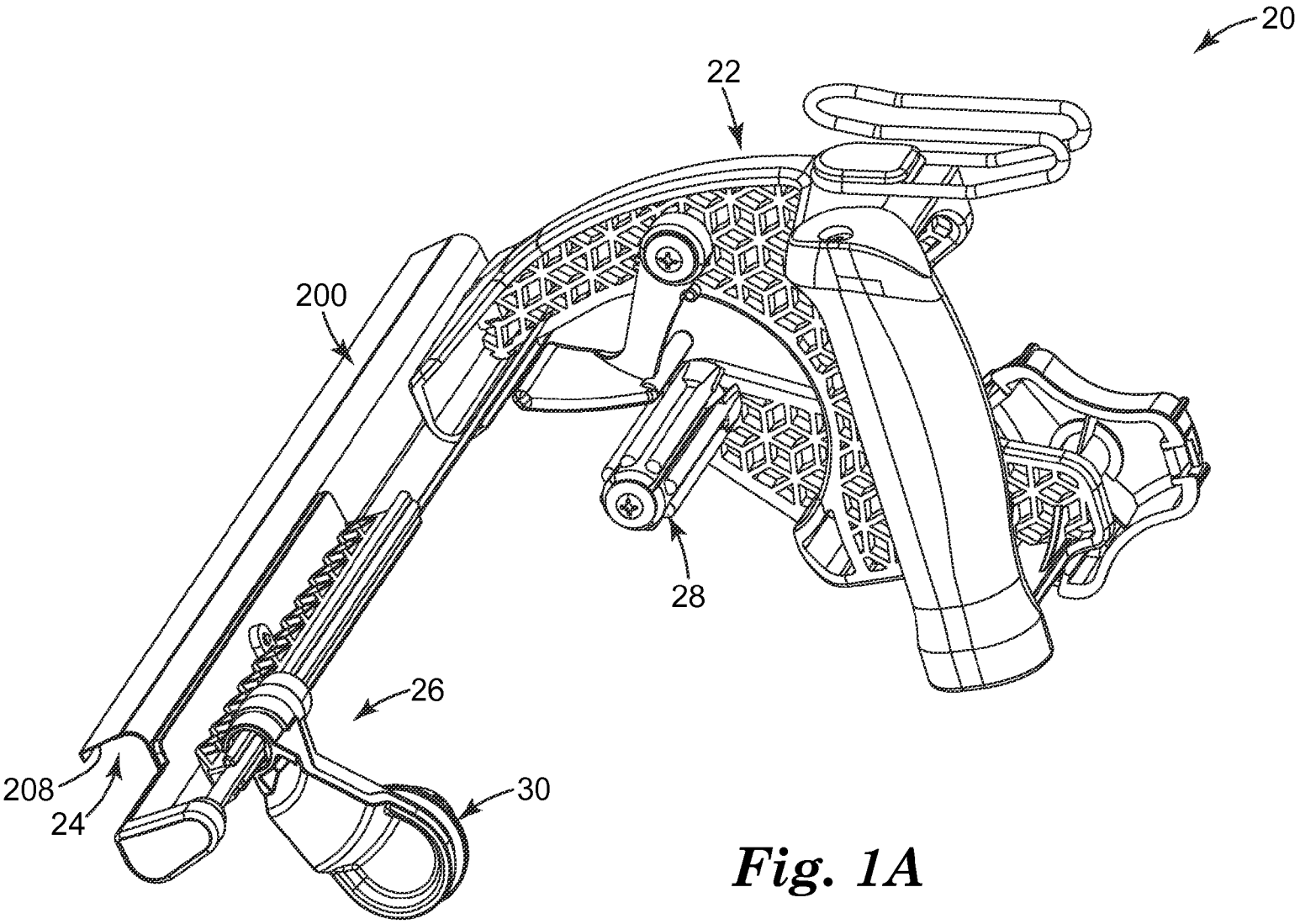
FIG. 1A is a first side perspective view of a dispenser in accordance with principles of the present disclosure.
Figure 1B:
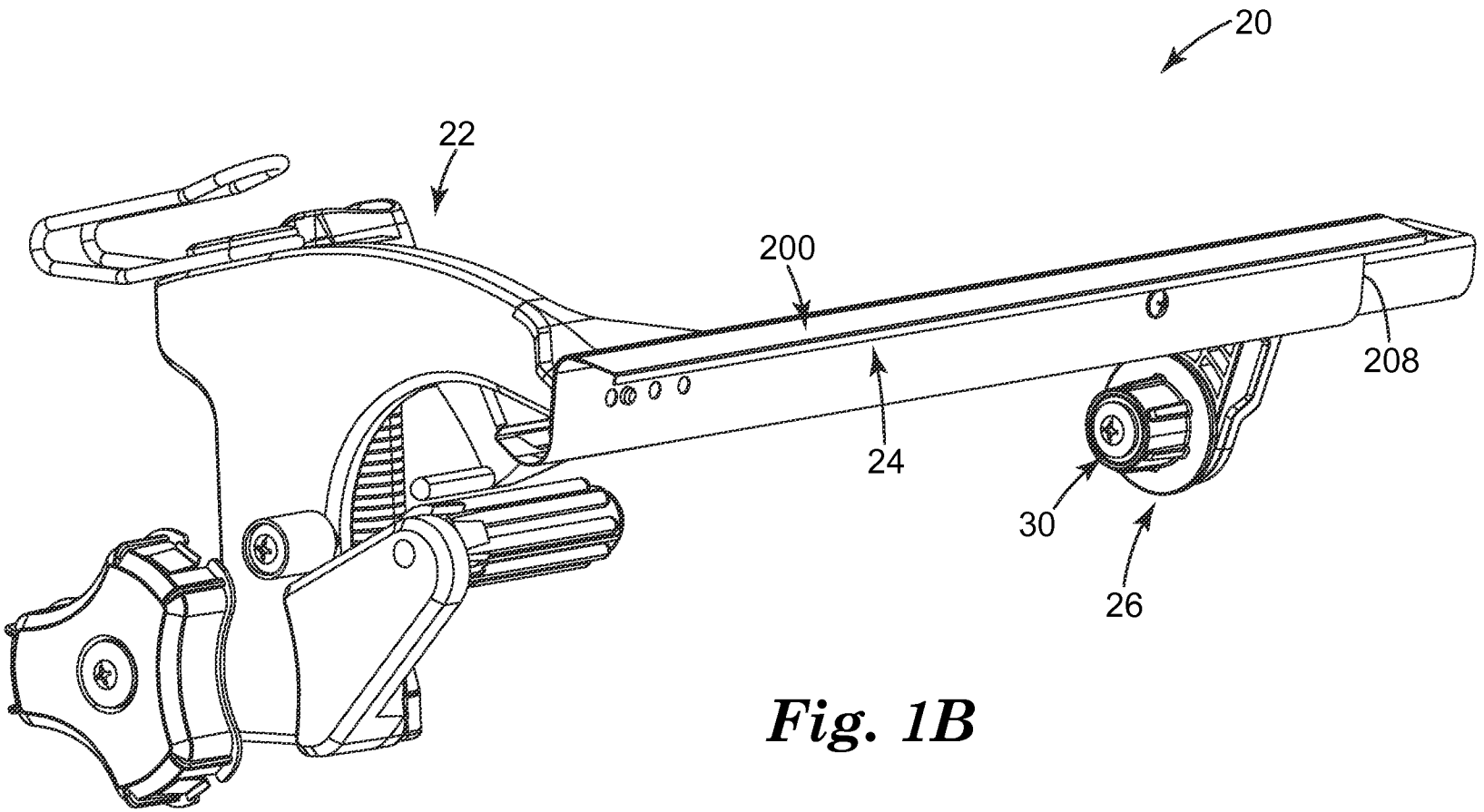
FIG. 1B is a second side perspective view of the dispenser of FIG. 1A.

One embodiment of a dispenser 20 in accordance with principles of the present disclosure is shown in FIGS. 1A and 1B, and includes a handle assembly 22, an elongated blade 24 (partially hidden in the views and referenced generally) and a support assembly 26. Details on the various components are provided below. In general terms, however, the handle assembly 22 includes or provides a hub 28 configured to selectively receive an end of a roll of sheet material (not shown). The elongated blade 24 is attached to and extends transversely from the handle assembly 22. The support assembly 26 is connected to the elongated blade 24 opposite the handle assembly 22, and includes or provides a support hub 30. The support hub 30 is configured to selectively receive an end of the roll of sheet material (i.e., the roll end opposite the end otherwise connected to the hub 28). The support assembly 26 is configured such that the support hub 30 can be manipulated or slid transversely relative to the handle assembly 22 (and thus relative to the hub 28) between locked and unlocked states. In the locked state, an axis the support hub 30 is substantially aligned (e.g., within 10% of a truly aligned relationship) with an axis of the hub 28, and is prevented from movement out the substantially aligned arrangement. In the unlocked position, the support hub 30 is can be rotated or pivoted out of the substantially aligned relationship with the axis of the hub 28. With this construction, the roll of sheet material is readily loaded onto the hub 28 with the support hub 30 in the unlocked state and pivoted out of alignment with the hub 28. The support hub 30 is than maneuvered into substantial alignment with the axis of the hub 28 (e.g., the locked state) and manipulated into engagement with the opposite end of the roll of sheet material. During a cutting operation, both ends of the elongated blade 24 are effectively connected with both ends of the roll of sheet material (via the hubs 28, 30), greatly reducing any relative movement between the elongated blade 24 and the roll of sheet material and thus resulting in a straighter cut. In some embodiments, the dispenser 20 optionally includes one or more additional features described below, such as a reinforced handle, a soft grip, a dual width tape hub, and a pocket clip.

As made clear below, some features of the present disclosure are embodied by the support assembly 26. The support assembly 26 can be provided as part of the dispenser 20, or in other embodiments can be assembled or retro-fitted to an existing sheet material dispenser that includes a conventional handle assembly (e.g. a frame rotatably maintaining a hub for receiving the roll of sheet material) and an elongated blade. Thus, the present disclosure is in no way limited to the handle assembly 22 (or the elongated blade 24) as described below. However, so as to give better context to features of the support assembly 26, the non-limiting exemplary handle assembly 22 and elongated blade 24 are initially described, followed by an explanation of the support assembly 26. As a point of reference, for ease of understanding, some components of the dispenser 20 are identified below as relating to handling of a "film" (as compared to masking sheet materials more generally). For example, the hub 28 can alternatively be referred to as a "film hub" 28. While the "film" nomenclature provides an easily understood distinction with other dispenser components intended to handle adhesive tape, it will be understood that the dispensers of the present disclosure are not limited for use with film-type masking sheet material, and other masking sheet materials, such as paper, are equally applicable.

Handle Assembly 22

Figure 2:
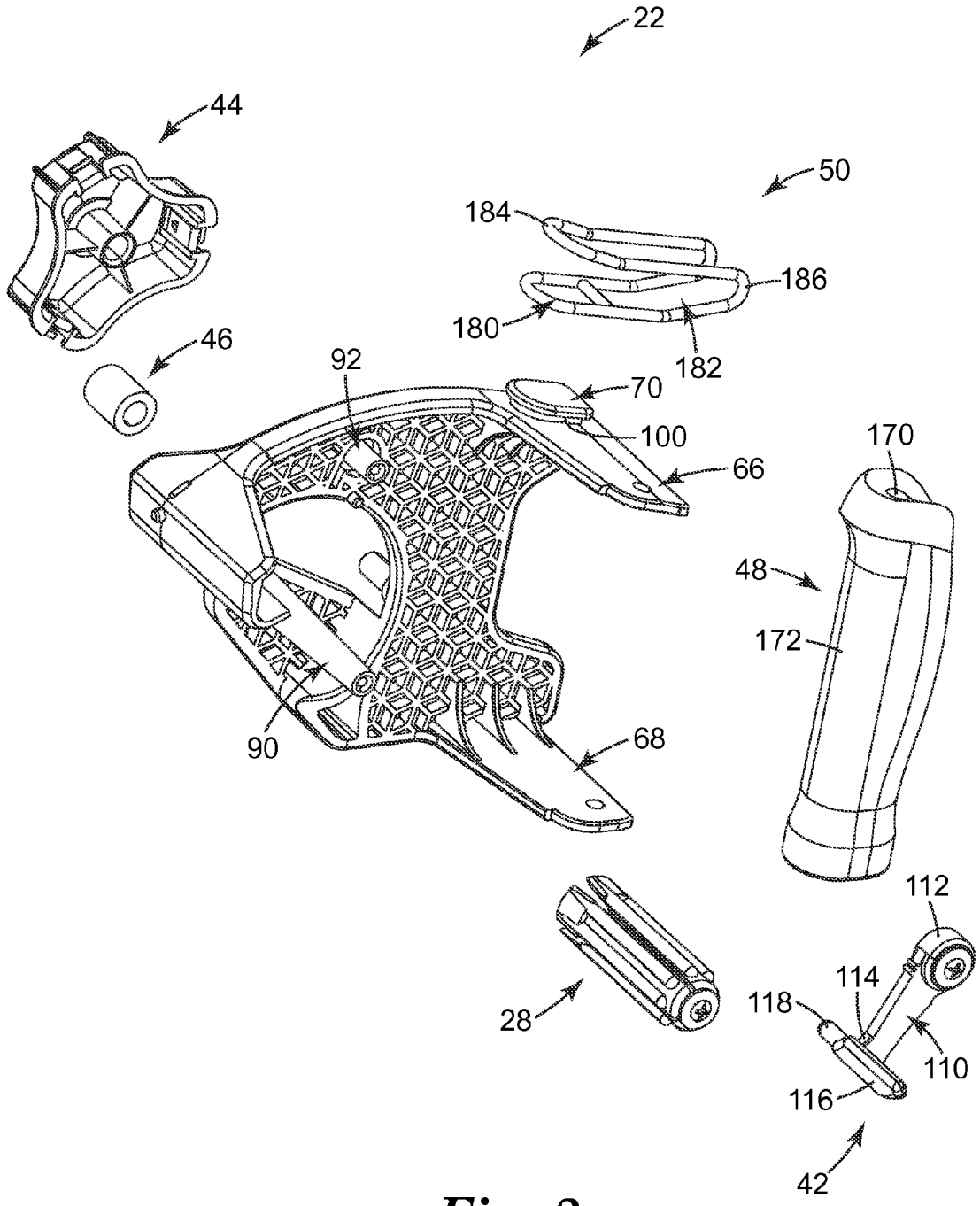
FIG. 2 is an exploded, perspective view of a handle assembly useful with the dispenser of FIG. 1A.

One non-limiting embodiment of the handle assembly 22 is shown in greater detail in FIG. 2 and includes a frame 40, the hub (or film hub) 28, a tensioning body 42, a tape hub 44, an optional tape roller 46, a grip 48, and an optional pocket clip 50. In general terms, the film hub 28 and the tape hub 44 are rotatably maintained by the frame 40. The tensioning body 42 is attached to the frame 40, located in dispensing paths (described below) associated with the hubs 28, 44. The tape roller 46, where provided, is connected to the frame 40 along a path between the tape hub 44 and the tensioning body 42. The grip 48 is attached to the frame 40, as is the optional pocket clip 50.

Figure 3A:
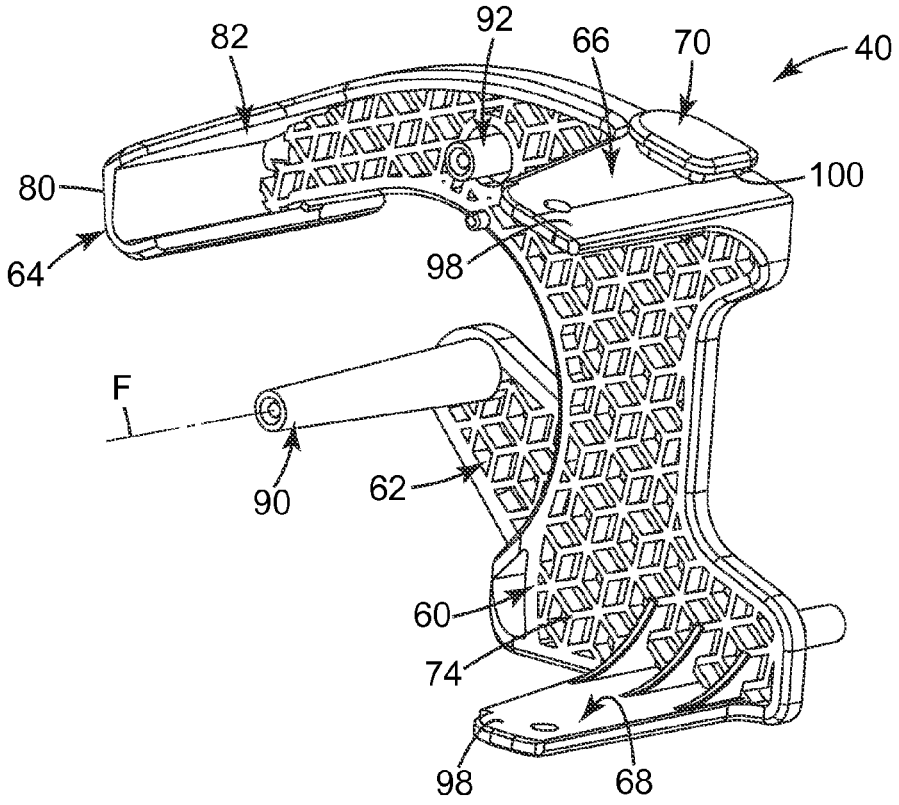
FIG. 3A in an interior perspective view of a frame component of the handle assembly of FIG. 2.
Figure 3B:
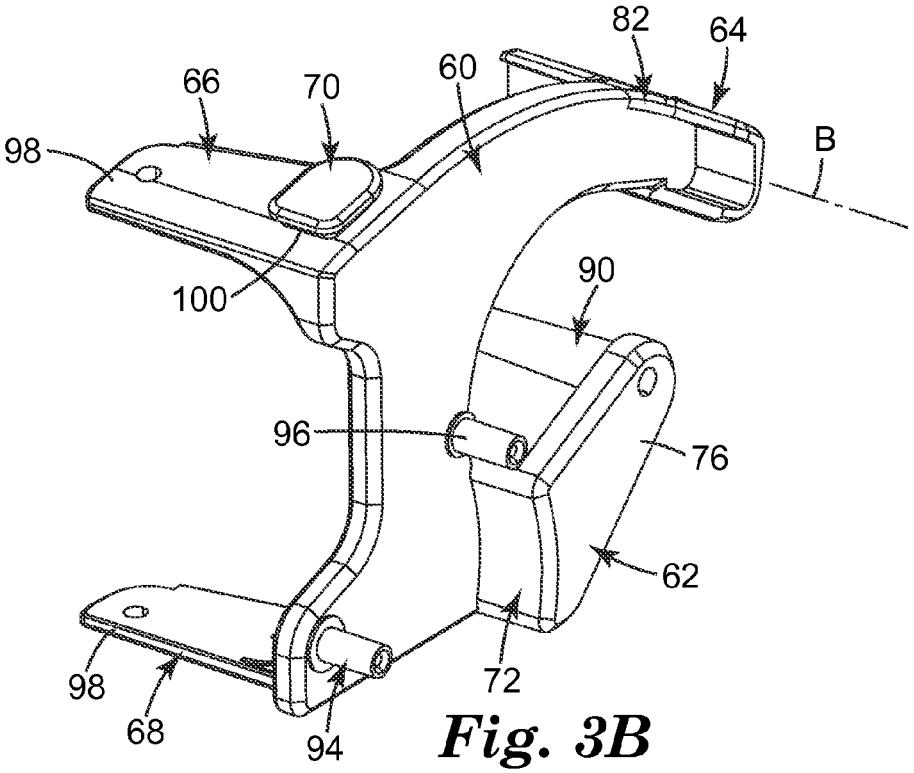
FIG. 3B is an exterior perspective view of the frame of FIG. 3A.

The frame 40 can assume a wide variety of shapes and sizes conducive to hand held operation of the dispenser 20 (FIGS. 1A and 1B), one example of which is shown in greater detail in FIGS. 3A and 3B. The frame 40 can be a molded plastic body or other rigid, hard material, and includes or defines a first panel section 60, a second panel section 62, a head 64, opposing arms 66, 68, and an optional cap 70. The first and second panel sections 60, 62 are affixed to one another (for example by a side wall 72), and form or carry features configured to promote assembly of other components of the handle assembly 22 (FIG. 2). In this regard, the panels section 60, 62 are configured to spatially maintain the so-assembled components in pre-determined planes relative to one another, and in some embodiments are substantially planar bodies (e.g., the first and second panel sections 60, 62 are within 10% of being truly planar). Further, a major plane established by the first panel section 60 is substantially parallel (e.g., within 10% of a truly parallel relationship) with a major plane established by the second panel section 62. For example, the major plane P1 of the first panel section 60 and the major plane P2 of the second panel section 62 are identified in FIG. 3C (the major planes P1, P2 are into or parallel to a plane of the page of FIG. 3C). While the panel sections 60, 62 are shown as being discrete bodies, in other embodiments, the frame 40 can include a single, substantially planar panel. Regardless, the frame 40 defines an interior face 74 (also visible FIG. 3A) and an exterior face 76 (also visible in FIG. 3B).

Figure 3C:
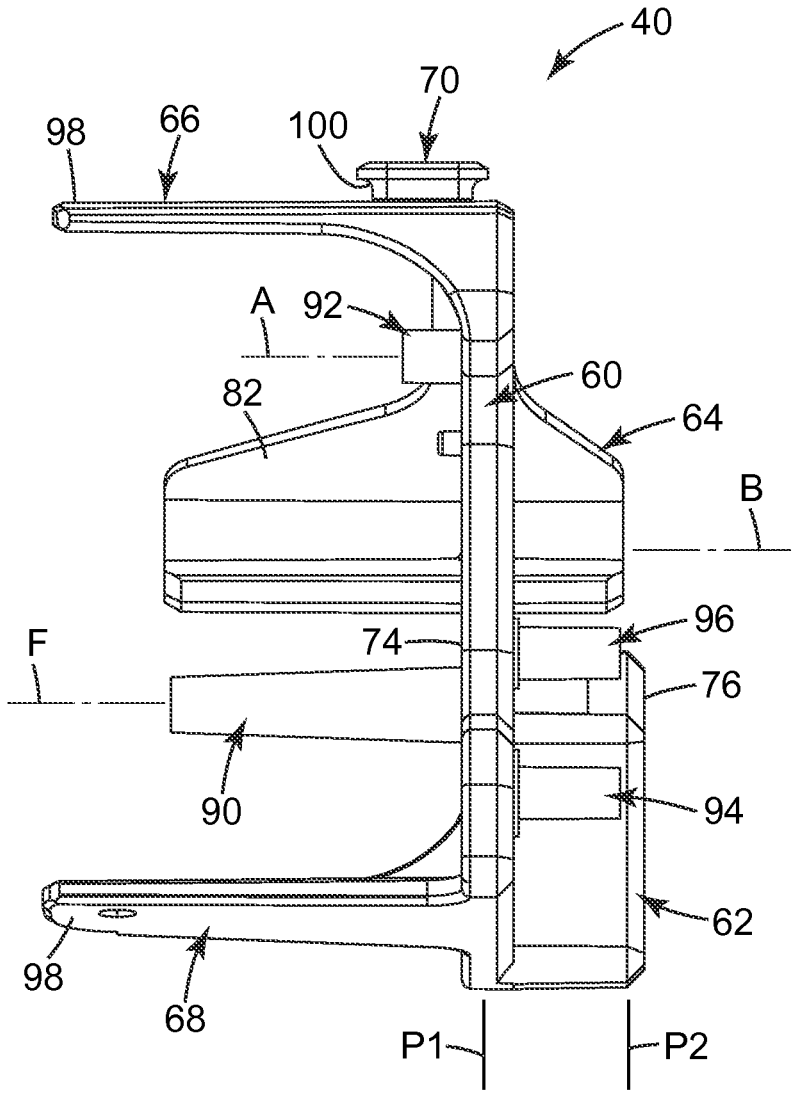
FIG. 3C is an end plan view of the frame of FIG. 3A.

With continued reference to FIGS. 3A-3C and as mentioned above, the head 64 is configured for mounting of the elongated blade 24 (FIGS. 1A and 1B). As described below, the elongated blade 24 has a generally linear cutting edge with the head 64 thus establishing a known spatial orientation of the cutting edge relative to the handle assembly 22 upon final assembly. With this in mind, the head 64 includes a mounting surface 80 configured to receive the elongated blade 24 and establishing a blade axis B along which the elongated blade 24 extends. The blade axis B is substantially linear (e.g., within 10% of truly linear orientation), and can be substantially perpendicular (e.g., within 10% of a truly perpendicular relationship) to the major planes P1, P2. In some embodiments, the mounting surface 80 can have an elongated shape (extending beyond the first panel section 60 in opposite directions), and further includes a gusset 82 or similar structure that reinforces the mounting surface 80.

As mentioned above, the frame 40 includes or forms various features for mounting of other components. For example, a film spindle 90 and a tension body spindle 92 project from the interior face 74 of the second and first panel sections 62, 60, respectively. The film spindle 90 is configured to rotatably maintain the film hub 28 (FIG. 2), whereas the tension body spindle 92 is configured for mounting of the tensioning body 42 (FIG. 2). In this regard, the film spindle 90 is configured to establish a film axis F about which the film hub 28 can rotate and that is substantially parallel (e.g., within 10% of a truly parallel relationship) with the blade axis B. In other embodiments, the film axis F can be described as being substantially perpendicular (e.g., within 10% of a truly perpendicular relationship) to the major planes P1, P2. A wide variety of other mechanisms or components can be employed for rotatably maintaining the film hub 28 relative to the frame 40 that may or may not include the film spindle 90. Similarly, mounting of the tensioning body 42 to the frame 40 is not limited to the tension body spindle 92 as shown, although a tensioning axis A can be established that in some embodiments that is substantially parallel (e.g., within 10% of a truly parallel relationship) with the blade axis B and/or is substantially perpendicular (e.g., within 10% of a truly perpendicular relationship) to the major planes P1, P2.

The frame 40 can further include or have assembled thereto a tape spindle 94 and a roller spindle 96 as projections from the exterior face 76 of the first panel section 60. The tape spindle 94 is configured to rotatably maintain the tape hub 44 (FIG. 2), whereas the roller spindle 96 is configured to rotatably maintain the tape roller 46 (FIG. 2). Various other mounting components can alternatively be provided. Regardless, a tape axis established by the tape spindle 94 (and about with the tape hub 44 can rotate) can be substantially parallel with the blade axis B, as can a roller axis established by the roller spindle 96 (and about with the tape roller 46 can rotate).

The arms 66, 68 project inwardly from the interior face 74, generally opposite the head 64. The arms 66, 68 each form a mounting end 98 opposite the first panel section 60 and generally configured for attachment to the grip 48 (FIG. 2). With this construction, the arms 66, 68 locate the grip 48 away from the first and second panel sections 60, 62, robustly coupling the grip 48 to the frame 40 in a reinforced fashion (e.g., the grip 48 is supported at both ends thereof). In other embodiments, the handle assembly 22 (FIG. 2) can incorporate other user-handling configurations such that one or both of the arms 66, 68 are optional and can be omitted.

The cap 70 can be provided with embodiments including the pocket clip 50 (FIG. 2) as described below. Where included, the cap 70 provides features corresponding with features of the pocket clip 50 to facilitate mounting of the pocket clip 50 to the frame 40. For example, the cap 70 can from a slot 100 sized and shaped to frictionally receive and retain the pocket clip 50 in a desired spatial orientation. The cap 70 can be separately formed and assembled to the frame 40, or alternatively can be integrally formed with the frame 40. The cap 70 can assume other formats, and in other embodiments can be omitted.

Returning to FIG. 2, the film hub 28 can assume a wide variety of forms, and is generally configured to receive an end of a roll of sheet material (not shown). More particular, an outer diameter of the film hub 28 is sized in accordance with an expected inner diameter of the core about with the roll of sheet material is formed, with the film hub 28 sized to be frictionally received within the core. Further, the film hub 28 is configured for rotatable mounting to the frame 40, for example over the film spindle 90.

The tensioning body 42 can assume a variety of forms, and is generally configured to apply tension to sheet material being dispensed from the roll of sheet material (not shown) and tape being dispensed from the roll of tape (not shown). In some embodiments, the tensioning body 42 includes a leg 110 extending between opposing, first and second end 112, 114. The first end 112 is configured to be rotatably mounted to the frame 40 (e.g., to the tension body spindle 92). A film guide 116 and a tape guide 118 project in opposite directions from the second end 114. The film guide 116 is generally shaped to slidingly interface with sheet material (e.g., sheet material, such as film, readily slides along the film guide 116), whereas the tape guide 118 is generally shaped to interface with a length of adhesive tape (not shown). The film guide 116 and the tape guide 118 can alternatively have a wide variety of other shapes or constructions that may or may not be directly implied by the FIGURES, and in other embodiments, one or both of the film guide 116 and the tape guide 118 can be omitted.

Figure 4A:
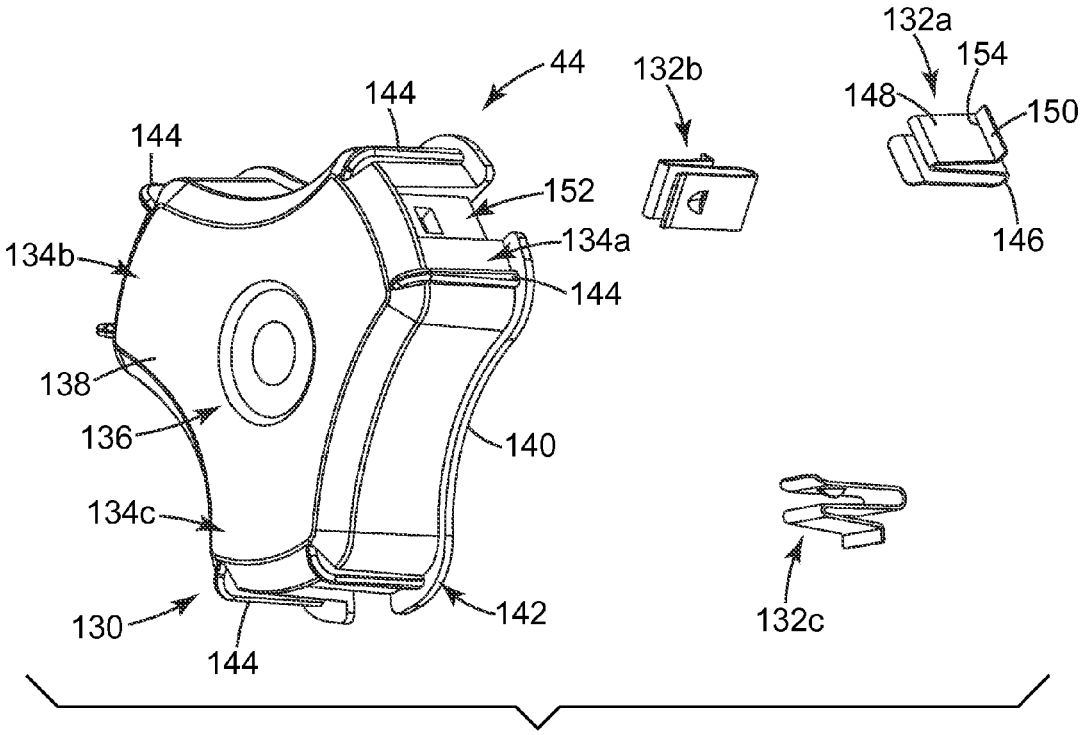
FIG. 4A is an exploded, perspective view of a tape hub component of the handle assembly of FIG. 2.
Figure 4B:
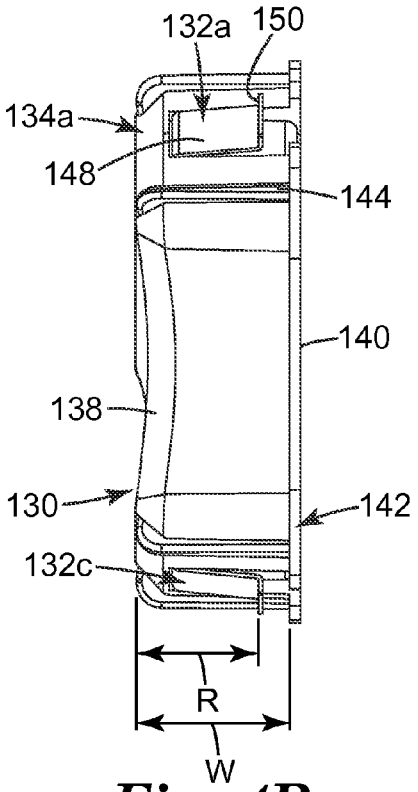
FIG. 4B is a side view of the tape hub of FIG. 4A.

The tape hub 44 can assume various forms for receiving a roll of tape (not shown). In general terms, an outer diameter of the tape hub 44 is sized in accordance with an expected inner diameter of the core about with the roll of adhesive tape is formed, with the tape hub 44 sized to be frictionally received within the core. Further, the tape hub 44 is configured for rotatable mounting to the frame 40, for example over the tape spindle 94 (FIG. 3B). In some embodiments, the tape hub 44 can incorporate features that readily facilitate mounting of tape rolls with differing widths and/or at longitudinal locations relative to a width of the tape hub 44. For example, one non-limiting embodiment of the tape hub 44 is shown in FIGS. 4A and 4B, and includes a hub body 130 and spring clips 132*a*-132*c*. The hub body 130 can form a shape generally appropriate for loading of a tape roll core (not shown)

thereto, for example via lobes 134*a*-134*c* projecting from a central segment 136. The hub body 130 further defines a leading face 138 opposite a trailing face 140, with an outwardly extending flange 142 at the trailing face 140. Each of the lobes 134*a*-134*c* forms or defines a receiving surface 144 against which the tape roll core is frictionally received, with the receiving surfaces 144 collectively defining a mounting diameter of the hub body 130 (with the mounting diameter selected in accordance with an expected inner diameter of the tape roll core). The mounting diameter (as collectively defined by the receiving surfaces 144 of the lobes 134*a*-134*c*) is substantially uniform in extension from the leading face 138 to the trailing face 140, with the flange 142 projecting outwardly beyond the mounting diameter and thus effectively establishing a stop to forced loading or movement of the tape roll core to the hub body 130 (in a loading direction from the leading face 138 toward the trailing face 140).

In some embodiments, a width W of the hub body 130 (distance between the leading face 138 and the flange 142) corresponds with the expected tape roll core width. In some end use applications, however, a smaller width tape roll may be employed and/or the user may desire to off-set the tape roll from the flange 142. The optional spring clips 132*a*-132*c* facilitate these desired usages. The spring clips 132*a*-132*c* can be identical, and some embodiments are formed of metal. Each of the spring clips 132*a*-132*c* includes a base structure 146, a spring arm 148 and a ramp 150. The base structure 146 is configured for assembly to the hub body 136, and in particular to a respective one of the lobes 134*a*-134*c* (for example, each of the lobes 134*a*-134*c* can form a platform 152 that is recessed relative to the corresponding receiving surface 144 and about which the base structure 146 is assembled). The spring arm 148 extends from the base structure 146, and terminates at a free end 154 that is biased away from the base structure. The ramp 150 projects from the free end 154 in a direction generally opposite the base structure 146. Each of the spring clips 132*a*-132*c* is sized and shaped such that upon final assembly to the hub body 130, the ramp 150 is longitudinally spaced from flange 142 in a direction of the leading face 138. Further, the spring arm 148 is biased to locate the ramp body 150 above (or beyond) the receiving surface 144 of the corresponding lobe 134*a*-134*c*. Thus, and as best reflected by FIG. 4B, the ramps 150 collectively define an outer diameter than is greater than the mounting diameter defined by the lobes 134*a*-134*c* (again, at the receiving surfaces 144) and a ramp width R that is less than the width W of the hub body 130.

Figure 4C:
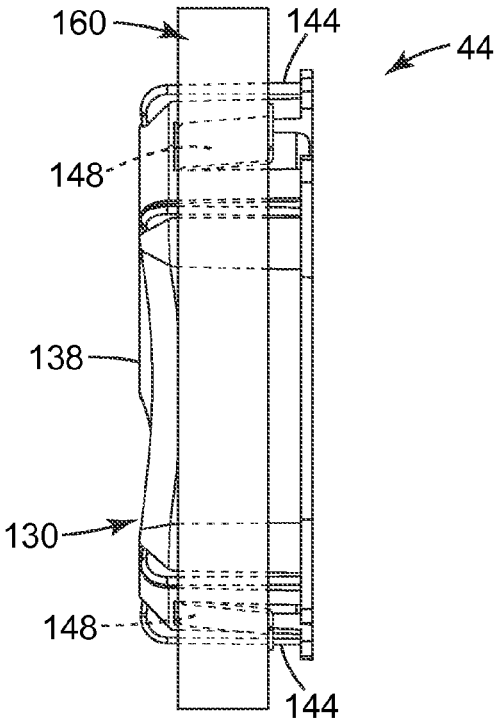
FIGS. 4C and 4D are side views illustrating loading of a tape roll on to the tape hub of FIG. 4B.
Figure 4D:
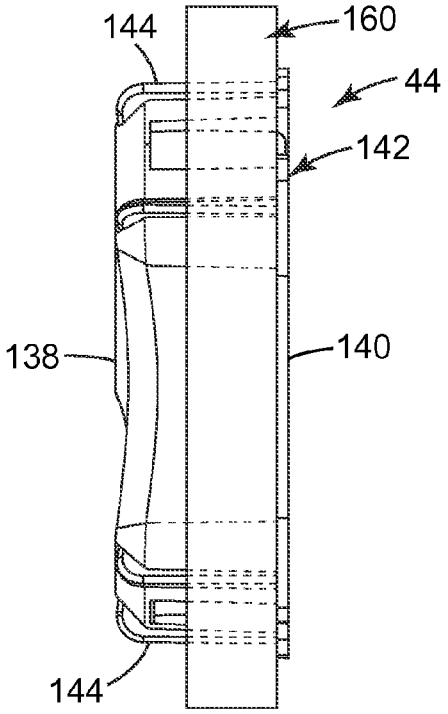

With the above construction, and as shown in FIG. 4C, a tape roll 160 (drawn schematically) can be loaded onto the tape hub 44 by sliding a core (hidden) of the tape roll 160 along the receiving surfaces 144, beginning at the leading face 138. As the tape roll 160 slides along the spring arms 148 (shown in FIG. 4C, but hidden beneath the tape roll 160 in actual practice), the spring arms 148 will deflect inwardly. However, once the tape roll 160 contacts the ramps 150, the user will tactically sense resistance to further movement, with the ramps 150 collectively aligning the tape roll 160 about the hub body 130. Upon removal of the tape roll 160, the spring arms 148 will self-revert back to the original, outwardly biased arrangement (as in FIG. 4B). In addition, FIG. 4D illustrates another arrangement of the tape roll 160 loaded to the tape hub 44. Once again, loading of the tape roll 160 on to the receiving surfaces 144 begins at the leading face 138, with the tape roll 160 being pushed or pressed in a direction of the trailing face 140. Upon reaching the ramps 150 (hidden in FIG. 4D), the user can determine that the tape roll 160 is desirably more fully loaded on to the tape hub 44; with further forced movement of the tape roll 160 in a direction of the trailing face 140, the spring arms 148 (hidden in FIG. 4D) will compress inwardly, with this inward deflection allowing the tape roll 160 to slide over the ramps 150 and into contact with the flange 142.

The tape hub 44 can include other components that promote mounting of a tape roll core. In other embodiments, the spring clips 132*a*-132*c* can be provided as integral components of the hub body 130. In yet other embodiments, the spring clips 132*a*-132*c* can be omitted.

Returning to FIG. 2, the tape roller 46 can assume various forms for interfacing with a length of adhesive tape in establishing a tape path from the tape hub 44. In some embodiments, the tape roller 46 is a cylindrical body configured to be rotatably mounted to the frame 40 (via the roller spindle 96 (FIG. 3B)). Alternatively, the tape roller 46 can be a static surface along which the adhesive tape is guided. In yet other embodiments, the tape roller 46 can be omitted.

The grip 48 is configured for assembly to frame 40, for example via affixed connection with the opposing arms 66, 68. The grip 48 can assume various forms conducive to ergonomic handling of the dispenser 20 (FIGS. 1A and 1B) by a single hand. In some embodiments, the grip 48 includes an inner post 170 and an outer grip member 172. The inner post 170 is formed of a robust, rigid material (e.g., hardened plastic), whereas the grip member 172 is a softer and/or more resilient material, such as a soft touch material, foam or rubber. The inner post 170 establishes a rigid, reinforced attachment with the arms 66, 68, while the soft grip member 172 is easier for a user to grip. In other embodiments, the grip 48 can be integrally formed and/or can incorporate other structures.

The optional pocket clip 50, where provided, can assume various forms useful for temporarily securing the dispenser 20 to a desired location during periods of intermittent use, such as a user's back pocket or other article on the user's person. With the one embodiment shown, the pocket clip 50 incorporates a feature corresponding with the cap 70 provided with the frame 40, for example a foot 180 sized to nest within the slot 100. Other mounting techniques are equally acceptable. Regardless, the pocket clip 50 defines a passage 182 extending between an open end 184 opposite a closed end 186. The pocket clip 50 is thus configured to be secured over an object by sliding the object into the passage 182 via the open end 184. In other words, a clipping direction is defined along the passage 182, from the open end 184 to the closed end 186. As described in greater detail below, upon final assembly, the pocket clip 50 is arranged such that the clipping direction is substantially perpendicular (e.g., within 10% of a truly perpendicular relationship) to the blade axis B (FIG. 3C) in some embodiments.

Figure 5A:
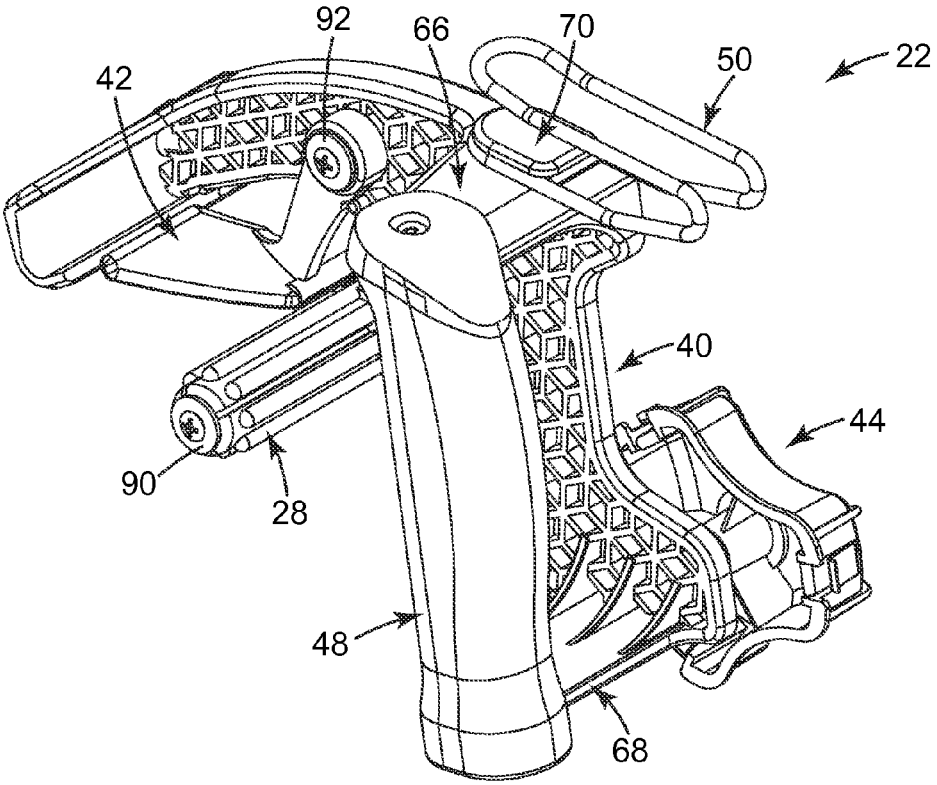
FIGS. 5A and 5B are perspective views illustrating the handle assembly of FIG. 2 upon final assembly.
Figure 5B:
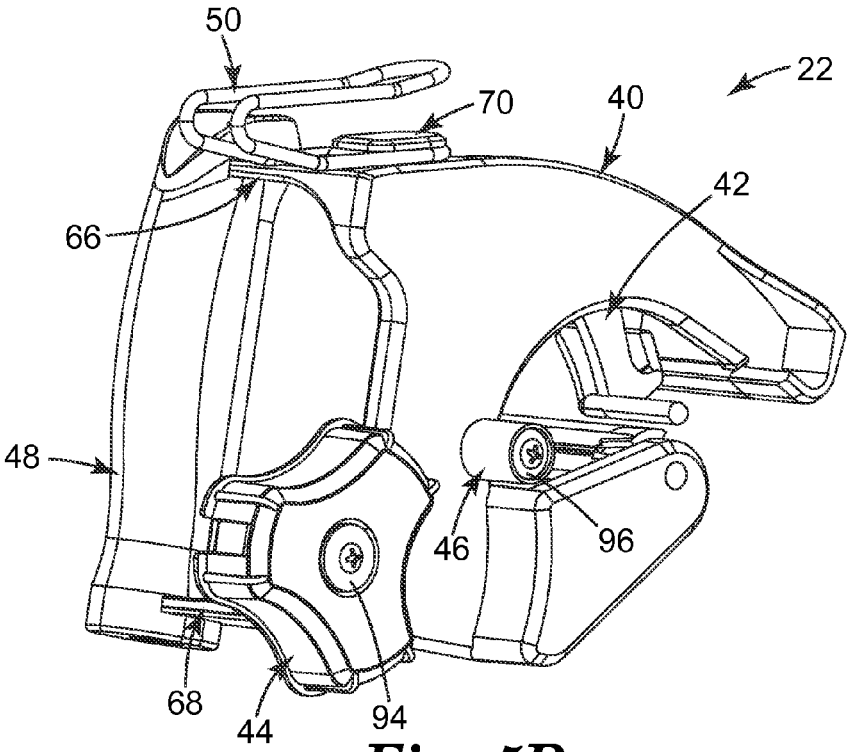
Figure 5C:
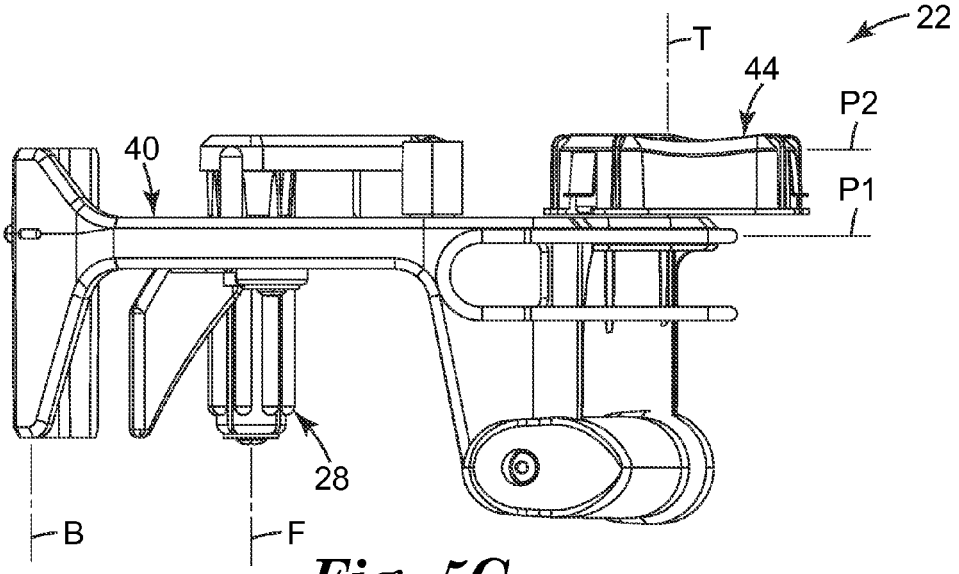
FIG. 5C is a top plan view of the handle assembly of FIGS. 5A and 5B.

Final construction of the handle assembly 22 is provided in FIGS. 5A and 5B. The film hub 28 is rotatably mounted to the frame 40 via the film spindle 90. The tensioning body 42 is mounted, optionally rotatably mounted, to the frame 40 via the tension body spindle 92. The tape hub 44 is rotatably mounted to the frame 40 via the tape spindle 94. The tape roller 46 is rotatably mounted to the frame 40 via the roller spindle 96. The grip 48 is affixed to the frame 40 by the arms 66, 68. Finally, the pocket clip 50 is attached to the frame 40 at the cap 70. FIG. 5C clarifies that upon final assembly, the film hub 28 is rotatable about the film axis F and the tape hub 44 is rotatable about the tape axis T. Once again, the film and tape axes F, T are substantially parallel to the blade axis B, and are optionally substantially perpendicular the major planes P1, P2 established by the frame 40.

Elongated Blade 24

Figure 6:
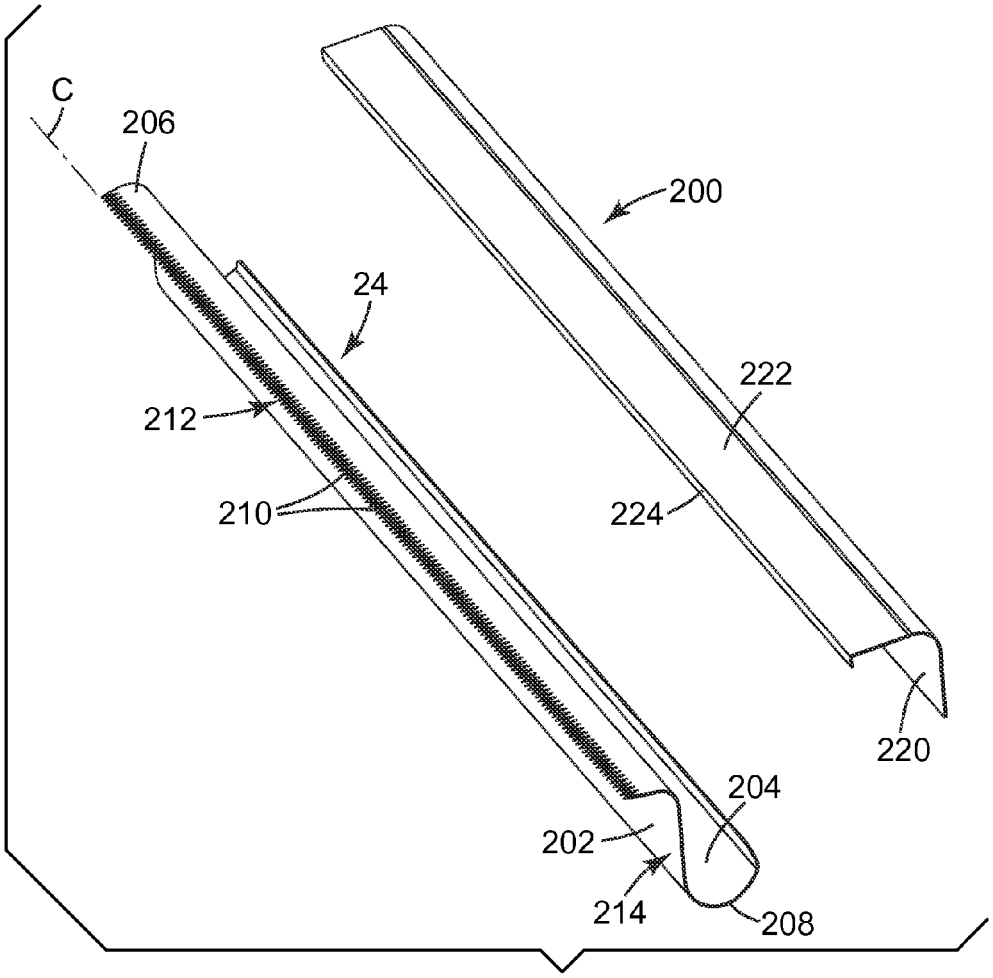
FIG. 6 is an exploded view of elongated blade and guard components of the dispenser of FIG. 1A.

Returning to FIGS. 1A and 1B, in some embodiments, the dispenser 20 optionally includes a guard 200 with the elongated blade 24. Alternatively, the guard 200 (and the elongated blade 24) can be considered a component of the support assembly 26. In yet other embodiments, the elongated blade 24 and the guard 200 are permanently assembled to one another (e.g., adhesive bond). Regardless, FIG. 6 illustrates the elongated blade 24 in conjunction with the guard 200. The elongated blade 24 is a thin metal material that has parallel opposite first and second major surfaces 202, 204. The elongated blade 24 can be curved along its length to have the generally J-shaped cross section shown, extending between opposing, first and second ends 206, 208. Teeth 210 are formed at a cutting edge 212 of the elongated blade 24, and are arranged such that the cutting edge 212 is substantially linear or planar (e.g., within 10% of a truly linear or planar surface) in extension between the first and second blade ends 206, 208. In some embodiments, each of the teeth 210 can have a triangular shape, with the tip or point of each tooth 210 being aligned with one another to establish the cutting edge 212 as being substantially planar, with a cutting axis C identified in FIG. 6. The elongated blade 24 is further configured for mounting to the handle assembly 22 (FIGS. 1A and 1B), for example via features (hidden) along an intermediate wall 214. The intermediate wall 214 is, in some embodiments, substantially planar (e.g., within 10% of a truly planar surface) between the opposing ends 206, 208 such that the cutting axis C is formed or maintained substantially parallel (e.g., within 10% of a truly parallel relationship) to a plane of the intermediate wall 214.

Where provided, the guard 200 is sized and shaped in accordance with a size and shape of the elongated blade 24, generally configured to partially cover the teeth 210 upon final assembly. For example, the guard 200 can include a rear member 220, a top member 222 and a lip 224. The rear member 220 is generally sized and shaped for placement over the second major surface 204 of the intermediate wall 214, and includes features (hidden) configured to facilitate mounting to the handle assembly 22 (FIGS. 1A and 1B) as described below. The top member 222 projects from the rear member 220, and the lip 224 projects from the top member 22 opposite the rear member 220. The top member 222 is sized and shaped to locate the lip 224 beyond and over the teeth 210 upon assembly of the guard 200 to the elongated blade 24. The guard 200 is configured such that the top member 222 can be elastically deflected relative to the rear member 220, for example to selectively move the lip 224 away from the teeth 210 during a cutting operation. The guard 200 can assume other forms that may or may not be directly implicated by FIG. 6, and in other embodiments can be omitted.

Figure 7A:
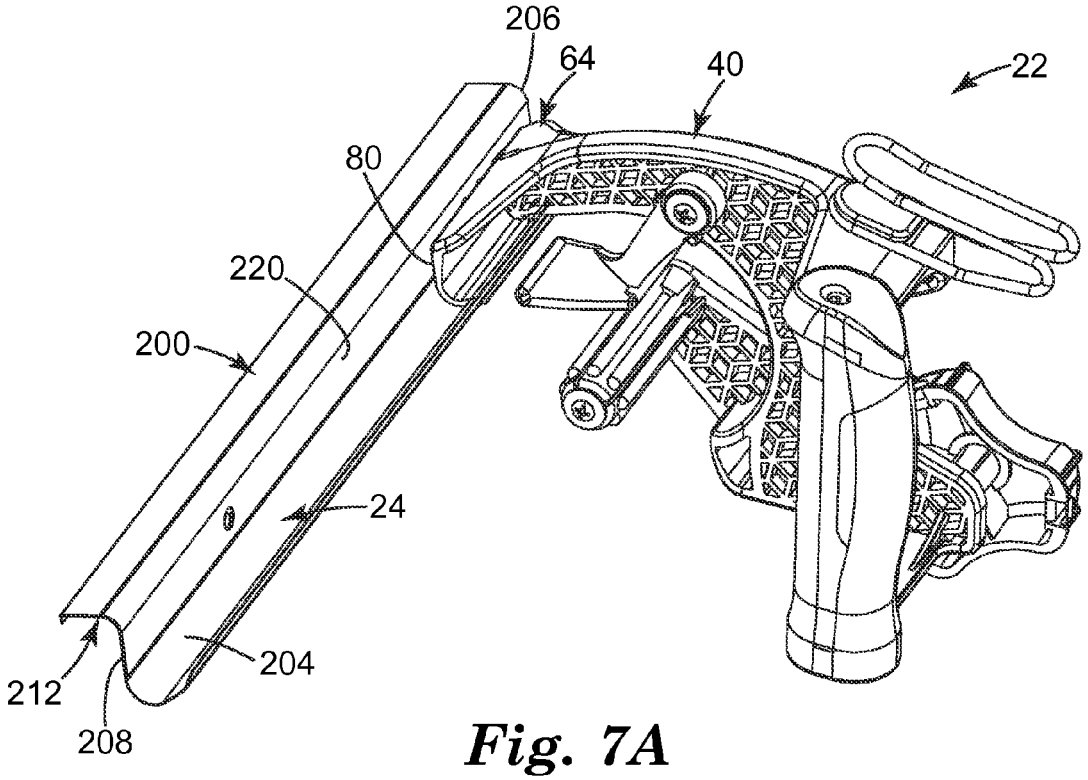
FIG. 7A is a perspective view illustrating mounting of the blade and guard of FIG. 6 to the handle assembly of FIG. 5A.
Figure 7B:
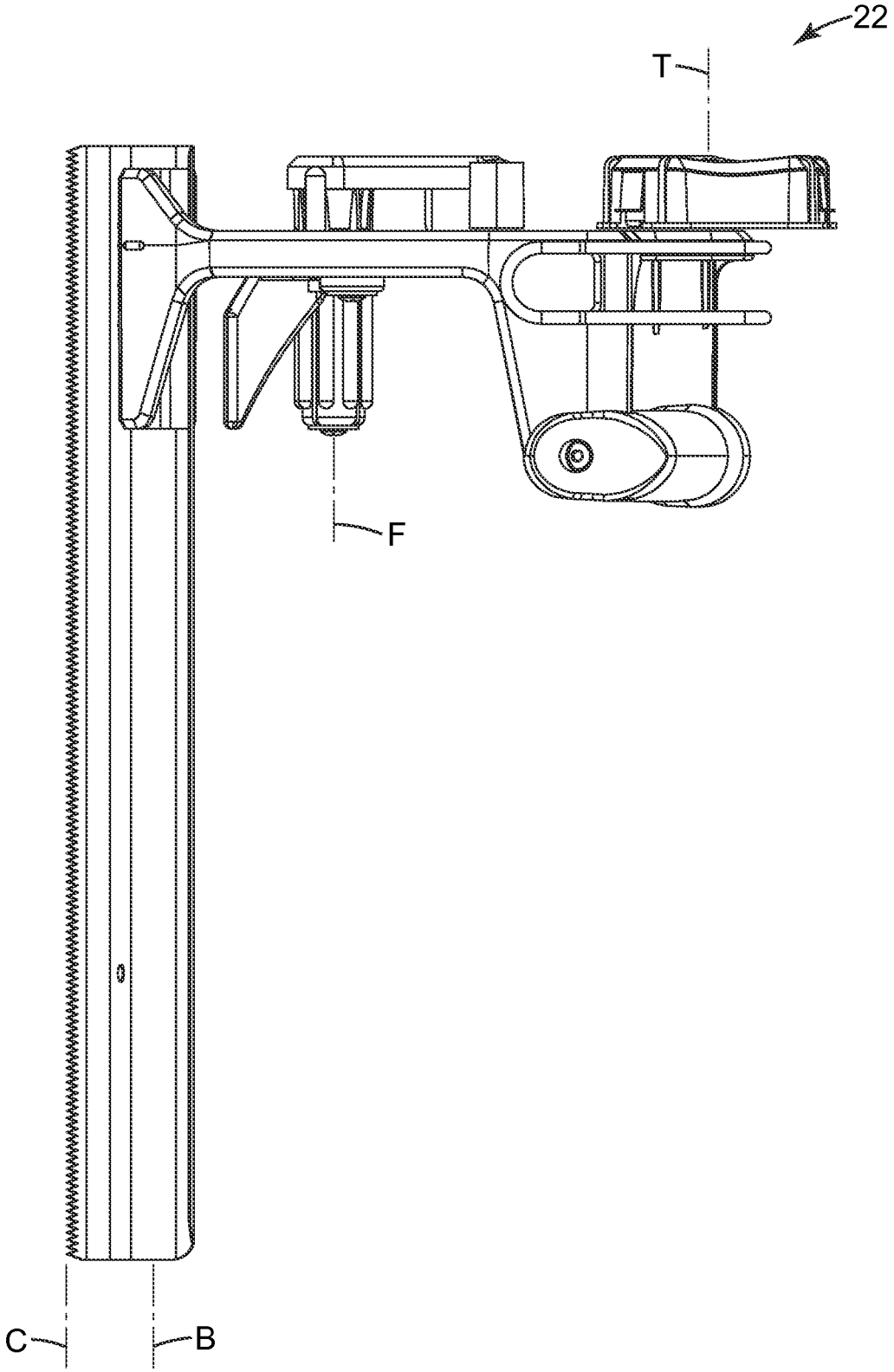
FIG. 7B is a top plan view of the assembly of FIG. 7A.

Coupling of the elongated blade 24 and of the guard 200 to the handle assembly 22 is shown in FIG. 7A (it being understood that the cutting edge 212 of the elongated blade 24 is primarily hidden or covered by the guard 200). The guard 200 is nested against the second major surface 204 of the elongated blade 24, and the elongated blade 24 and the guard 200 are attached to the head 64 of the frame 40. As shown, the first end 206 of the elongated blade 24 is located at or immediately proximate the frame 40, with the elongated blade 24 (and the guard 200) extending from the frame 40 to space the second end 208 away from the handle assembly 22 (in a direction opposite the exterior face 76 (FIG. 3C)). The rear member 220 of the guard 200 abuts, and is substantially flush against, the mounting surface 80 (referenced generally) of the head 64. Similarly, the intermediate wall 214 (hidden in FIG. 7A but shown in FIG. 6) of the elongated blade 24 abuts, and is substantially flush against, the rear member 220. Thus, a spatial arrangement of the elongated cutting blade 24, and in particular the cutting edge 212, is dictated by the mounting surface 80. It will be recalled that the mounting surface 80 is substantially planar in some embodiments. Thus, upon final assembly and as best reflected by FIG. 7B (that otherwise omits the guard 200 for ease of understanding) the handle assembly 22 establishes and maintains the cutting plane or axis C to be spaced from but substantially parallel (e.g., within 10% of a truly parallel relationship) with the blade axis B. Further, and consistent with previous explanations, the cutting axis C is spatially spaced from but substantially parallel (e.g., within 10% of a truly parallel relationship) with the film axis F and the tape axis T.

Support Assembly 26

Returning to FIGS. 1A and 1B, the support assembly 26 is generally configured to support a roll of sheet material (not shown) relative to the second end 208 of the elongated blade 24. With this in mind, one embodiment of the support assembly 26 is shown in greater detail in FIG. 8, and includes a bracket 250, a brace 252 and the support hub 30. The bracket 250 is configured for mounting to the blade 24 (FIGS. 1A and 1B) and/or the optional guard 200 (FIG. 6). The brace 252 is configured to be movably coupled to the bracket 250, and rotatably maintains the support hub 30. As described below, with this construction, the brace 252 is selectively movable relative to the bracket 250, affording a user the ability to spatially position the support hub 30 relative to the bracket 250 (and thus relative to the handle assembly 22 (FIGS. 1A and 1B) to load, unload, and support a roll of sheet material.

Figure 9A:
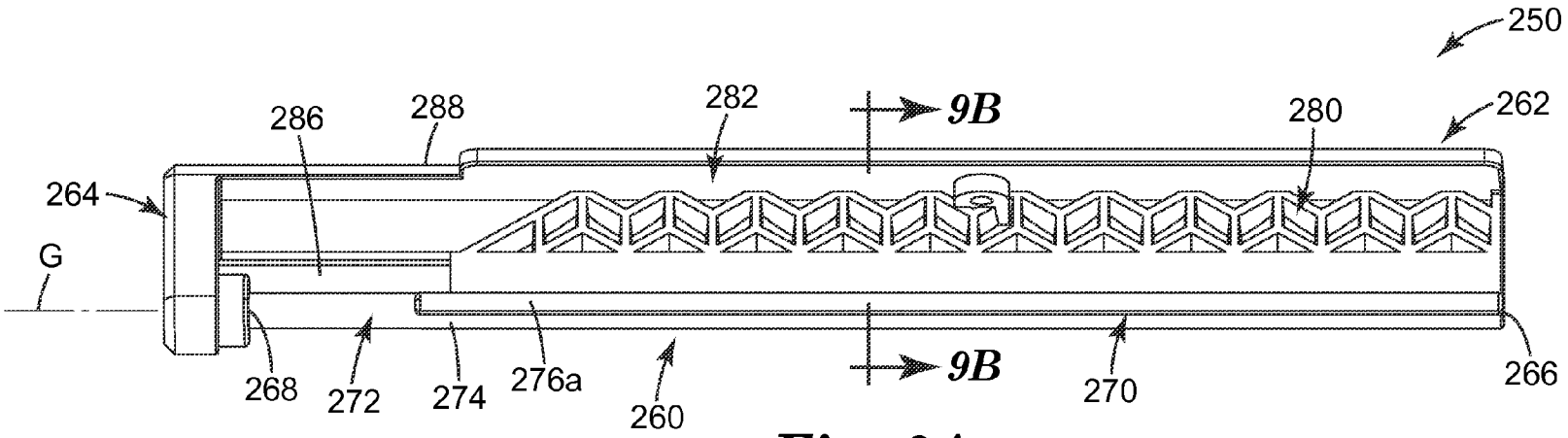
FIG. 9A is a top plan view of a bracket component of the support assembly of FIG. 8.
Figure 9B:
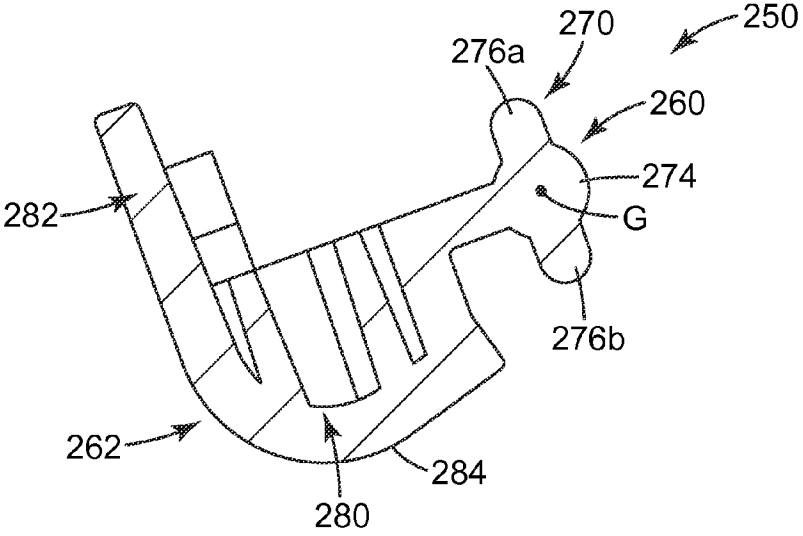
FIG. 9B is a cross-section of the bracket of FIG. 9A, taken along the line 9B-9B.

With additional reference to FIGS. 9A and 9B, the bracket 250 includes or defines a guide track 260, a beam 262, and a shoe 264. The guide track 264 is configured to slidably maintain the brace 252 and extends between opposing, first and second track ends 266, 268. The guide track 264 defines first and second track segments 270, 272, with the first track segment 270 extending from the first track end 266 and the second track segment 272 extending from the first track segment 270 to the second track end 268. In general terms, each of the track segments 270, 272 is configured to slidably maintain the brace 252 as described below. However, the first track segment 270 includes one or more features not provided with the second track segment 272 (or vice-versa) and selected in accordance with features of the brace 252 such that the brace 252 can rotate relative to the guide track 264 along the second track segment 272 but is prevented from rotating relative to the guide track 264 along the first track segment 270.

The guide track 264 generally includes a primary track body 274 extending entirely to and between the first and second track ends 266, 268. The primary track body 274 defines a guide axis G and can be cylindrical or substantially cylindrical in some embodiments, although other shapes are contemplated. The second track segment 272 consists of the primary track body 274 alone. As best shown in FIG. 9B, the guide track 264 further includes or forms one or more tabs 276*a*, 276*b* as radial extensions from the primary track body 274 along the first track segment 270. Stated otherwise, the tabs 276*a*, 276*b* terminate at the second track segment 272, and can extend along a majority, optionally an entirety, of the first track segment 270. As described below, the tabs 276*a*, 276*b* are sized and shaped in accordance with corresponding features provides with the brace 252 (FIG. 8), and serve to rotationally lock the brace 252 relative to the first track segment 270. Because the tabs 276*a*, 276*b* are not provided along the second track segment 272, the brace 252 can more freely rotate about the primary track body 274.

Figure 8:
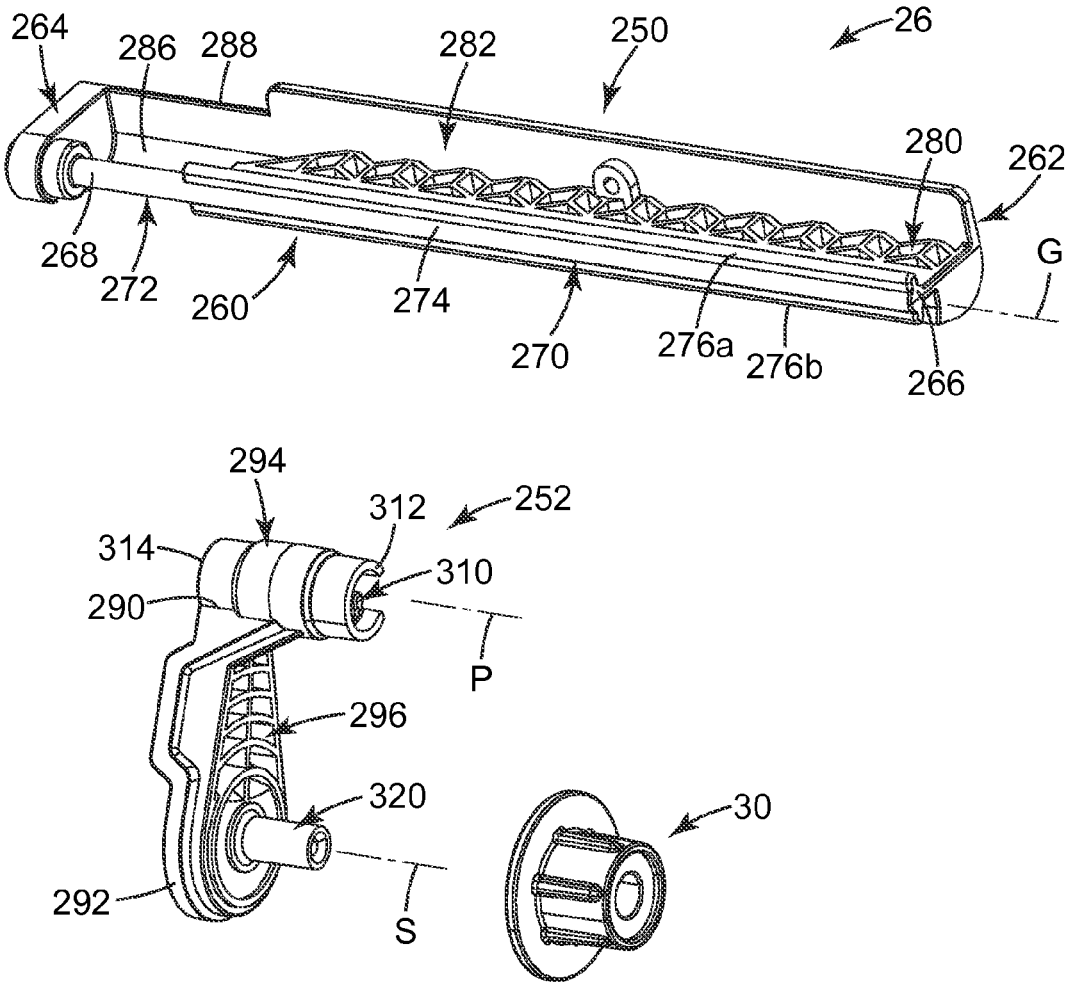
FIG. 8 is an exploded, perspective view of a support assembly in accordance with principles of the present disclosure and useful with the dispenser of FIGS. 1A and 1B.

With reference to FIGS. 8-9B, the beam 262 includes or forms a base 280 and a neck 282. A portion of a length of the guide track 264 (e.g., the first tack segment 270) extends from the base 280, with an outer surface 284 of the base 280 being sized and shaped for nested mounting to a geometry of the elongated blade 24 (FIGS. 1A and 1B) in some embodiments. The base 280 thus serves to support the guide track 264 relative to the elongated blade 24, and can optionally have the honeycomb-like construction illustrated in FIG. 8. Regardless, the base 280 can extend to (e.g., is contiguous with) the first track end 266. However, the base 280 terminates at or adjacent the second track segment 272, generating a gap 286 for reasons made clear below. The neck 282 projects from the base 280 opposite the guide track 264, and can include or incorporate features for assembly to the elongated blade 24. In this regard, the neck 282 is configured for substantially flush abutment against the blade 24 (e.g., the intermediate wall 214 (FIG. 6)) and thus can be substantially flat in some embodiments. As reflected by FIGS. 8 and 9A, the neck 282 is continuous in extension between the first and second track ends 266, 268, and bounds the gap 286 opposite the guide track 260. In some embodiments, the neck 282 forms or defines a notch 288 that is spatially aligned with the second track segment 272 for reasons made clear below.

The shoe 264 is attached to and extends between the guide track 260 and neck 282 at the second track end 268. With this arraignment, the neck 282 reinforces or stabilizes guide track 260 at the second track end 268 via the shoe 264. Further, and as described below, the shoe 264 provides a stop to sliding movement of the brace 252 from the guide track 260.

Figure 10A:
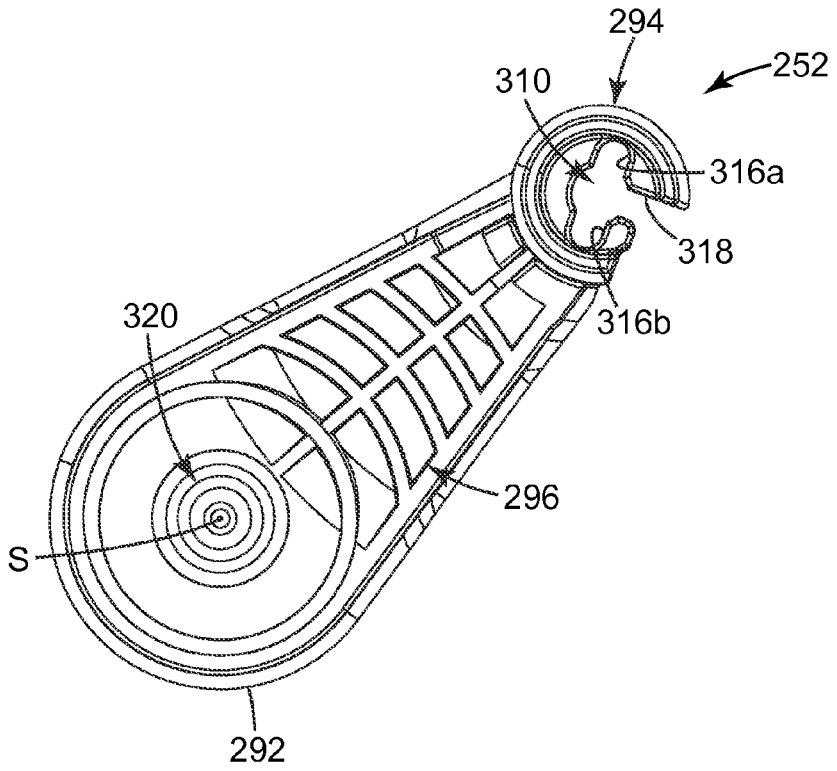
FIG. 10A is a side view of a brace component of the support assembly of FIG. 8.

With specific reference to FIG. 8, the brace 252 generally defines a leading side 290 opposite a trailing side 292. The brace 252 can have various forms, and in some embodiments includes or forms a collar 294 at or adjacent the leading side 290. A brace member 296 projects from the collar 294 to the trailing side 292. With additional reference to FIG. 10A, the collar 294 forms a central passage 310 sized to slidably receive the primary track body 274. The central passage 310 extends between and is open relative to opposing ends 312, 314 of the collar 294, and has a diameter approximating a diameter of the primary track body 274. Further, the collar 294 forms one or more keying slots 316*a*, 316*b* as radial extensions from the central passage 310. The keying slots 316*a*, 316*b* are open to the central passage 310 and are sized and shaped in accordance with a size and shape of the guide track tabs 276*a*, 276*b*. More particularly, each of the keying slots 316*a*, 316*b* are configured to slidably receive a corresponding one of the tabs 276*a*, 276*b*, and are arranged relative to the central passage 310 in accordance with an arrangement of the tabs 27*a*, 276*b* relative to the primary track body 274 (e.g., where the tabs 276*a*, 276*b* are arranged approximately 180 degrees relative to one another, the keying slots 316*a*, 316*b* are similarly arranged 180 degrees relative to one another). In some embodiments, the collar 294 can further form a channel 318 that is open to the central passage 310. The channel 318 facilitates assembly of the collar 294 on to the guide track 260, but can have a width smaller than the tabs 276*a*, 276*b* such that the tabs 276*a*, 276*b* cannot be received within the channel 318. In other embodiments, the channel 318 can be omitted.

Figure 10B:
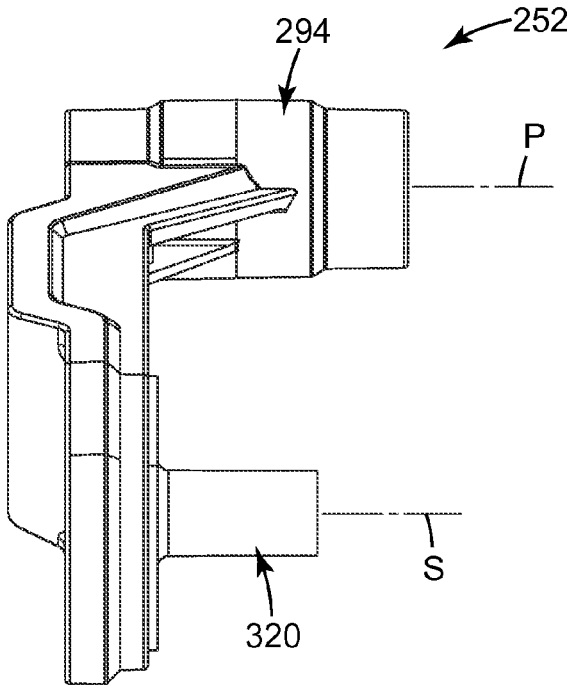
FIG. 10B is an end view of the brace of FIG. 10A.

The brace member 296 forms or carries one more features for rotatably maintaining the support hub 30. For example, a spindle 320 can be provided as a projection from the brace member 296 adjacent the trailing side 292. Regardless of exact form, a support hub axis S is established about with the support hub 30 can rotate. The support hub axis S is defined by the brace 252 at a known spatial location relative to the collar 294, and in particular relative to an axis P defined by the central passage 310. As best indicated in FIG. 10B, the support hub axis S is substantially parallel (e.g., within 10% of a truly parallel relationship) with the passage axis P. As made clear below, a spacing or distance between the support hub axis S and the passage axis P corresponds with known geometries provided by the handle assembly 22 (FIGS. 1A and 1B).

Returning to FIG. 8, the support hub 30 can assume a variety of forms appropriate for receiving an end of a roll of sheet material (not shown). More particular, an outer diameter of the support hub 30 is sized in accordance with an expected inner diameter of the core about with the roll of sheet material is formed, with the support hub 30 sized to be frictionally received within the core. Further, the support hub 30 is configured for rotatable mounting to the frame brace 252, for example over the spindle 320.

Figure 11A:
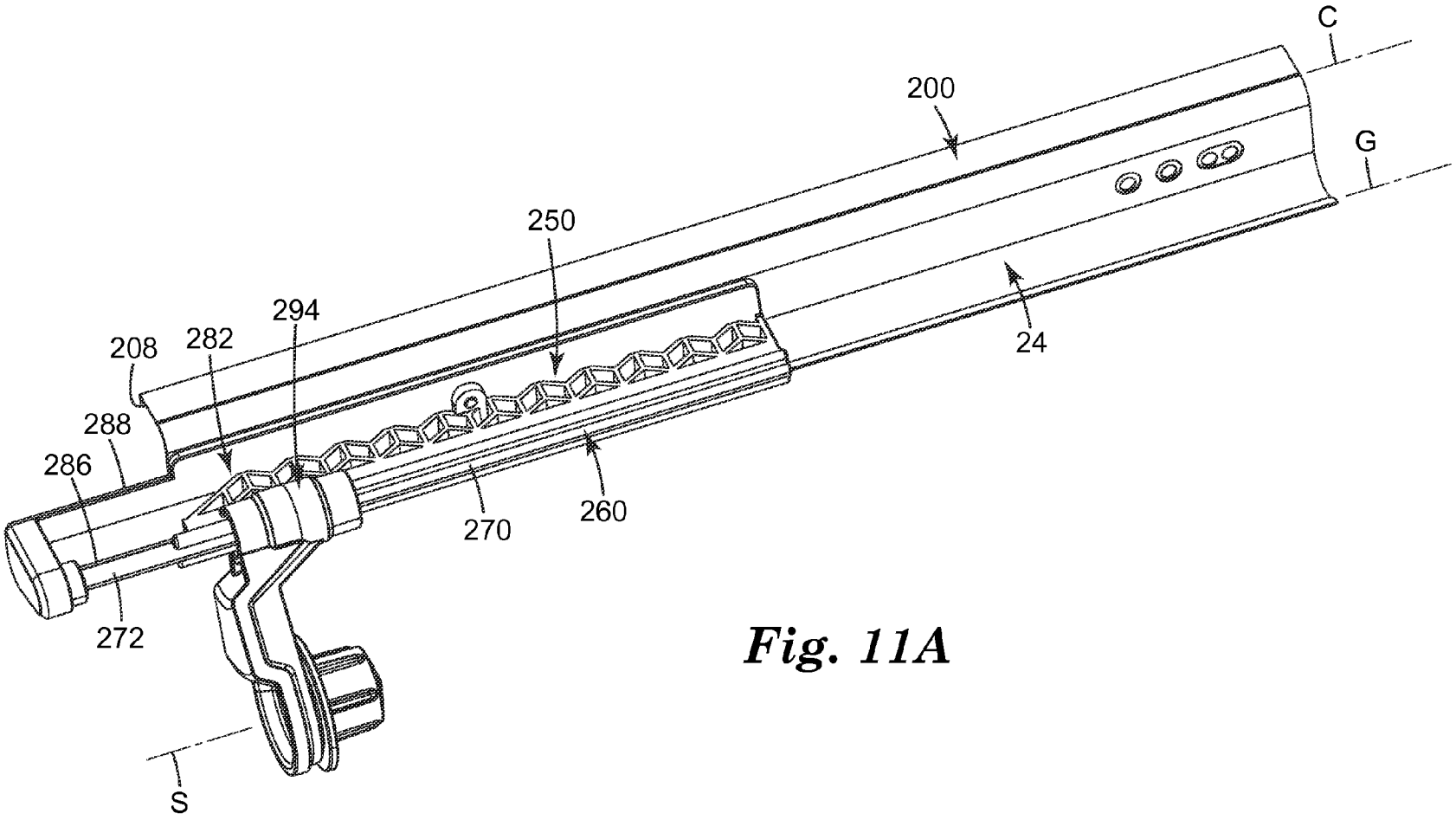
FIG. 11A is a perspective view illustrating the support assembly of FIG. 8 mounted to the blade and guard of FIG. 6, and arranged in a locked state.

FIG. 11A illustrates final construction and mounting of the support assembly 26 to the elongated blade 24 (and the optional guard 200). The bracket 250 is affixed to the elongated blade 24, locating the guide track 260 at a fixed spatial location relative to the cutting axis C. As shown, the bracket 250 extends beyond the second end 208 of the elongated blade 24. For example, the bracket 250 is optionally arranged such the first track segment 270 terminates at or immediately adjacent the blade second end 208, and the second track segment 272 extends longitudinally beyond the blade second end 208. Regardless, the guide axis G is substantially parallel (e.g., within 10% of a truly parallel relationship) with the cutting axis C.

Figure 11B:
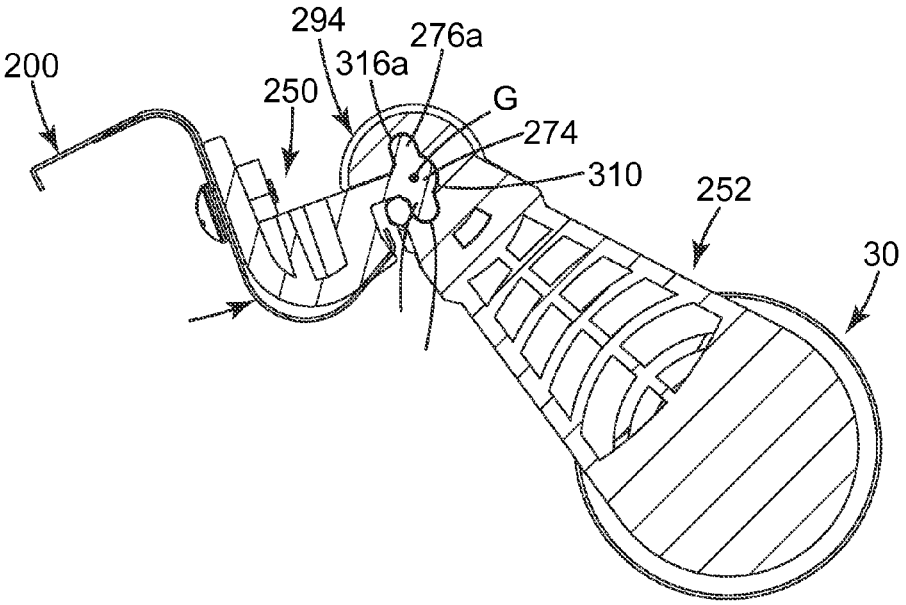
FIG. 11B is a cross-sectional view of the arrangement of FIG. 11A.
Figure 11C:
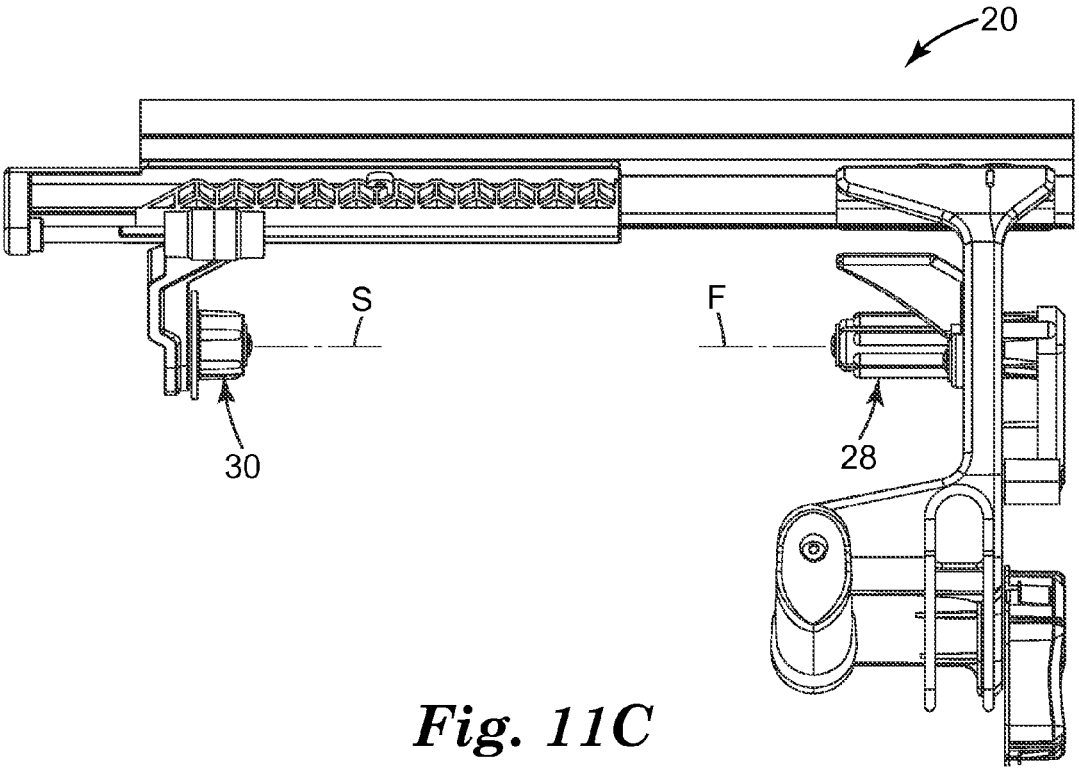
FIG. 11C is a top plan view of the dispenser of FIG. 1A and illustrating a relationship between hub components.

The collar 294 is slidably connected to the guide track 260, and can slide longitudinally along the guide axis G. In the locked state arrangement of FIG. 11A, the collar 294 is located along or over the first track segment 270. As shown in FIG. 11B, in the locked state, the primary track body 274 is received within the central passage 310, the first tab 276*a* is received within the first keying slot 316*a*, and the second tab 276*b* is received within the second keying slot 316*b*. Thus, while the collar 294 can slide along the first track segment 270, an interface between the tabs 276*a*, 276*b* and the corresponding keying slots 316*a*, 316*b* prevents the collar 294 from rotating relative to the guide track 260 (e.g., rotating about the guide axis G). In the locked state, and as reflected by FIG. 11A, the support hub axis S is substantially parallel (e.g., within 10% of a truly parallel relationship) with the cutting axis C. As a point of reference, FIG. 11C reflects that in the locked state, the support hub axis S is also substantially aligned (e.g., within 10% of a truly aligned relationship) with the film axis F. In the locked state dictated by an interface between the collar 294 and the first track segment 270, the brace 252 can slide longitudinally toward or away from the film hub 28 (with the length of travel in the lock state bounded by a length of the first track segment 270) with the support hub 30 retained in substantial alignment with the film hub 28 and prevented from rotating out of substantial alignment.

Figure 11D:
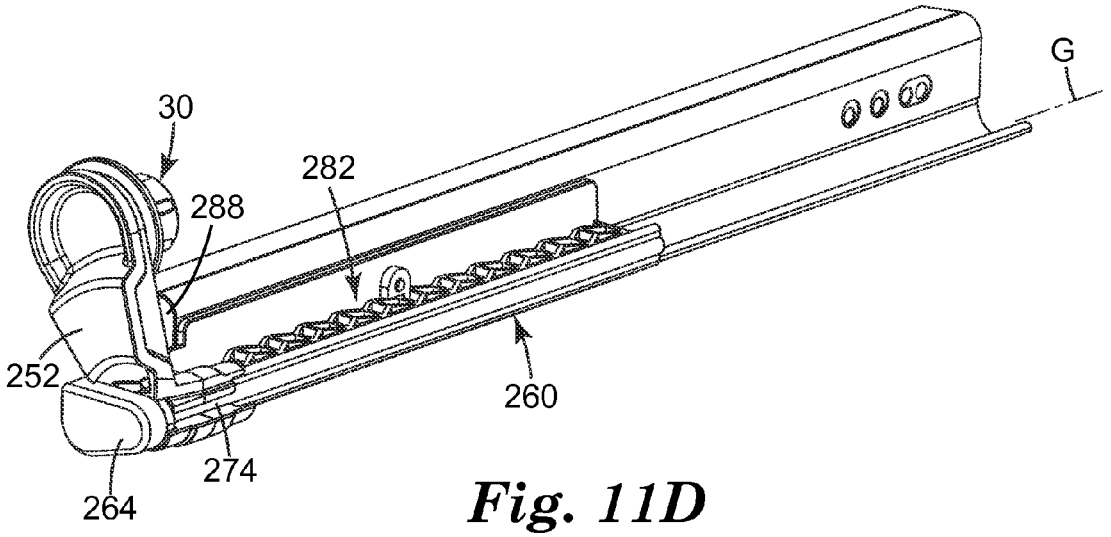
FIG. 11D is a perspective view of the assembly of FIG. 11A, with the support assembly arranged in an unlocked state.
Figure 11E:
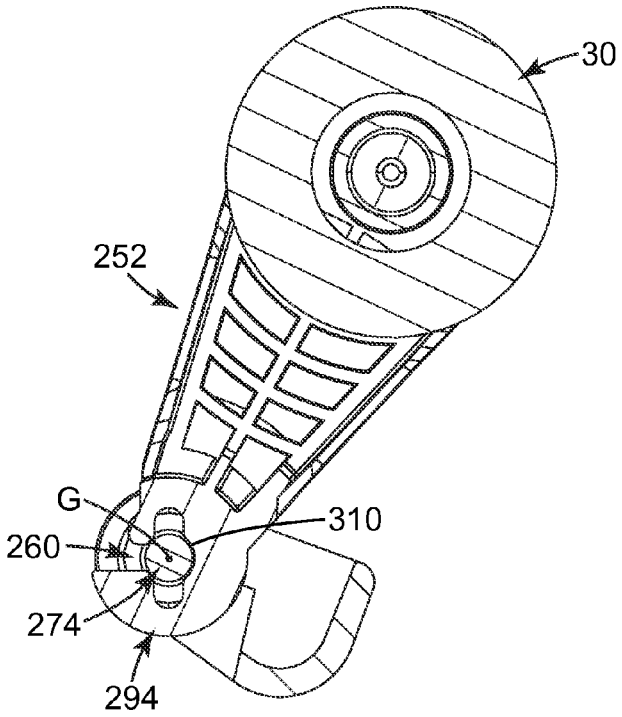
FIG. 11E is a cross-sectional view of the arrangement of FIG. 11D.

The collar 294 can further be slid along the guide track 260 to the second track segment 272 at which an unlocked state is established as shown in FIG. 11D. The shoe 264 prevents the collar 294 from being slid entirely off of the second track segment 272. In the unlocked state, and with additional reference to FIG. 11E, the primary track body 274 continues to be received within the central passage 310. However, the keyed relationship (of the locked state described above) between the collar 294 and the guide track 260 does not exist along the second track segment 272 (e.g., the tabs 276*a*, 276*b* (FIG. 11B) are not provided along the second track segment 272), such that the collar 294 can freely rotate relative to the guide track 260 about the guide axis G. In other words, in the unlocked state, the brace 252, and thus the support hub 30, can move or slide longitudinally along the guide axis G and can rotate about the guide axis G to move the support hub 30 out of substantial alignment with the film hub 28 (FIGS. 1A and 1B). Though partially hidden in the view of FIG. 11D, a more complete range of available rotational movement of the brace 252 relative to the guide track 260 is promoted by the gap 286 in the base 280 and the notch 288 in the neck 282.

With reference between FIGS. 11A-11E, while the keyed relationship between the first track segment 270 and the collar 294 has been described as including the tabs 276*a*, 276*b* on the guide track 260 and the keying slots 316*a*, 316*b* in the collar 294, a number of other configurations are also envisioned, capable of permitting sliding movement of the brace 252 along the guide axis G, permitting rotation of the brace 252 about the guide axis G in the unlocked state, and preventing rotation of the brace 252 about the guide axis G in the locked state (and in which the support hub axis S is substantially aligned with the film axis F). For example, slots can be formed in the guide track 260 and corresponding tabs formed by collar 294.

Methods of Use

Figure 12A:
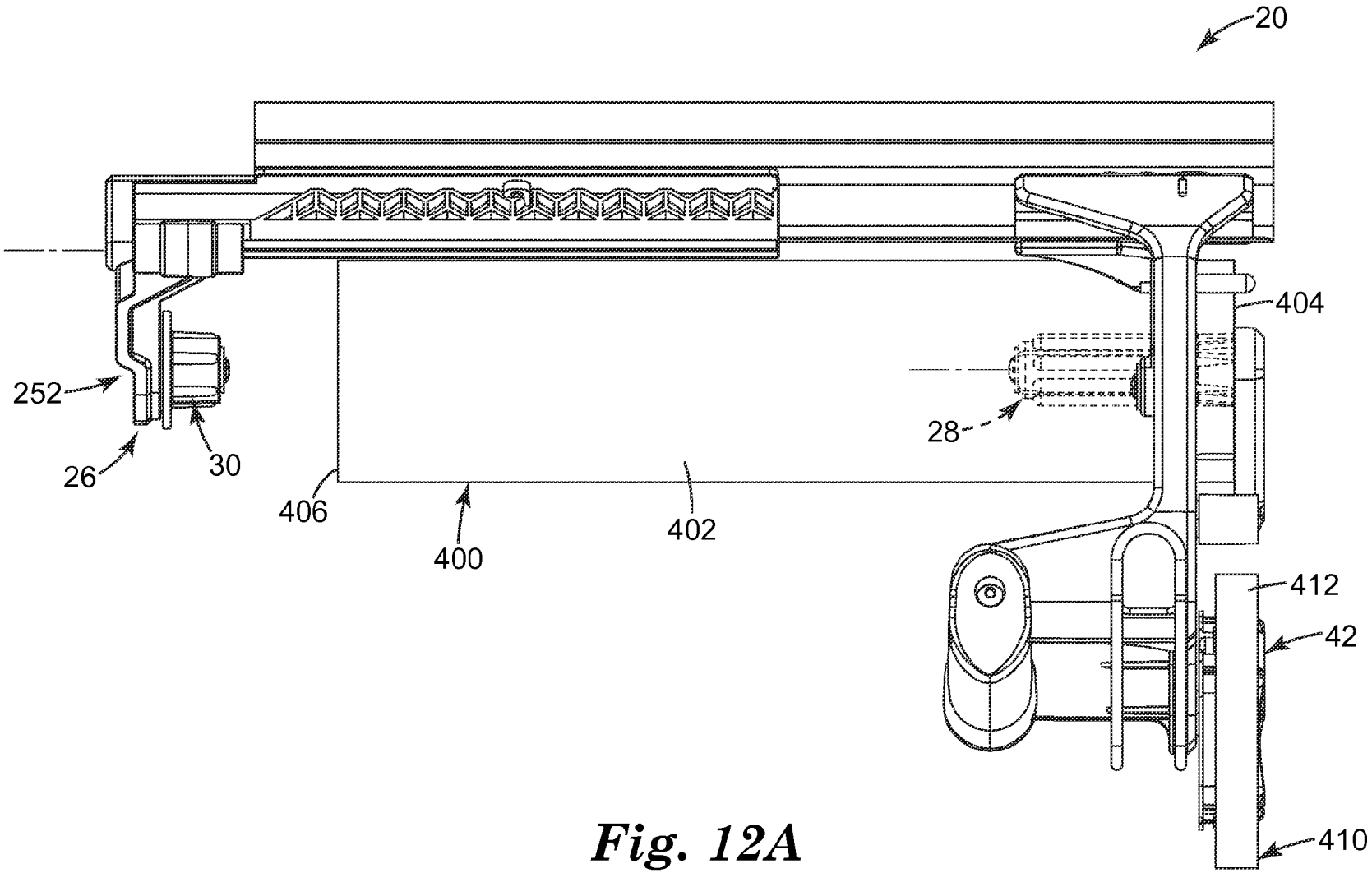
FIGS. 12A-12C illustrating loading and use of the dispenser of FIGS. 1A and 1B.

With reference to FIG. 12A, preparation of the dispenser 20 for applying a composite masking sheet material to a surface includes arranging the dispenser 20, and in particular the support assembly 26, in the unlocked state. A roll 400 (drawn in schematically) of sheet material 402 is then loaded to the dispenser 20. The masking sheet material 402 of the roll 400 can be of paper or of polymeric materials, can be unfolded or can be longitudinally folded as described, for example, in U.S. Pat. No. 4,913,767, or can be a flattened length of tubular material. Regardless, the roll 400 defines opposing, first and second roll ends 404, 406. The first end 404 is loaded onto or over the film hub 28. By moving the brace 252, and thus the support hub 30 longitudinally away from the film hub 28, the roll 400 can easily be arranged in axial alignment with film hub 28 (e.g., the support hub 30 does not interfere with or contact the roll second end 406); if necessary or desired, the brace 252 can be rotated relative to the guide axis G (and thus relative to the film axis F) to move the support hub 30 further away from the roll second end 406 (e.g., the arrangement of FIG. 11D) so as to further simplify loading of the roll first end 404 on to the film hub 28. A roll 410 (drawn schematically) of adhesive tape 412 is loaded on to the tape hub 42. The adhesive tape 412 can be of any type conventionally employed with composite sheet masking material applications, and can generally include a surface coated with an adhesive, such as a pressure sensitive adhesive.

Figure 12B:
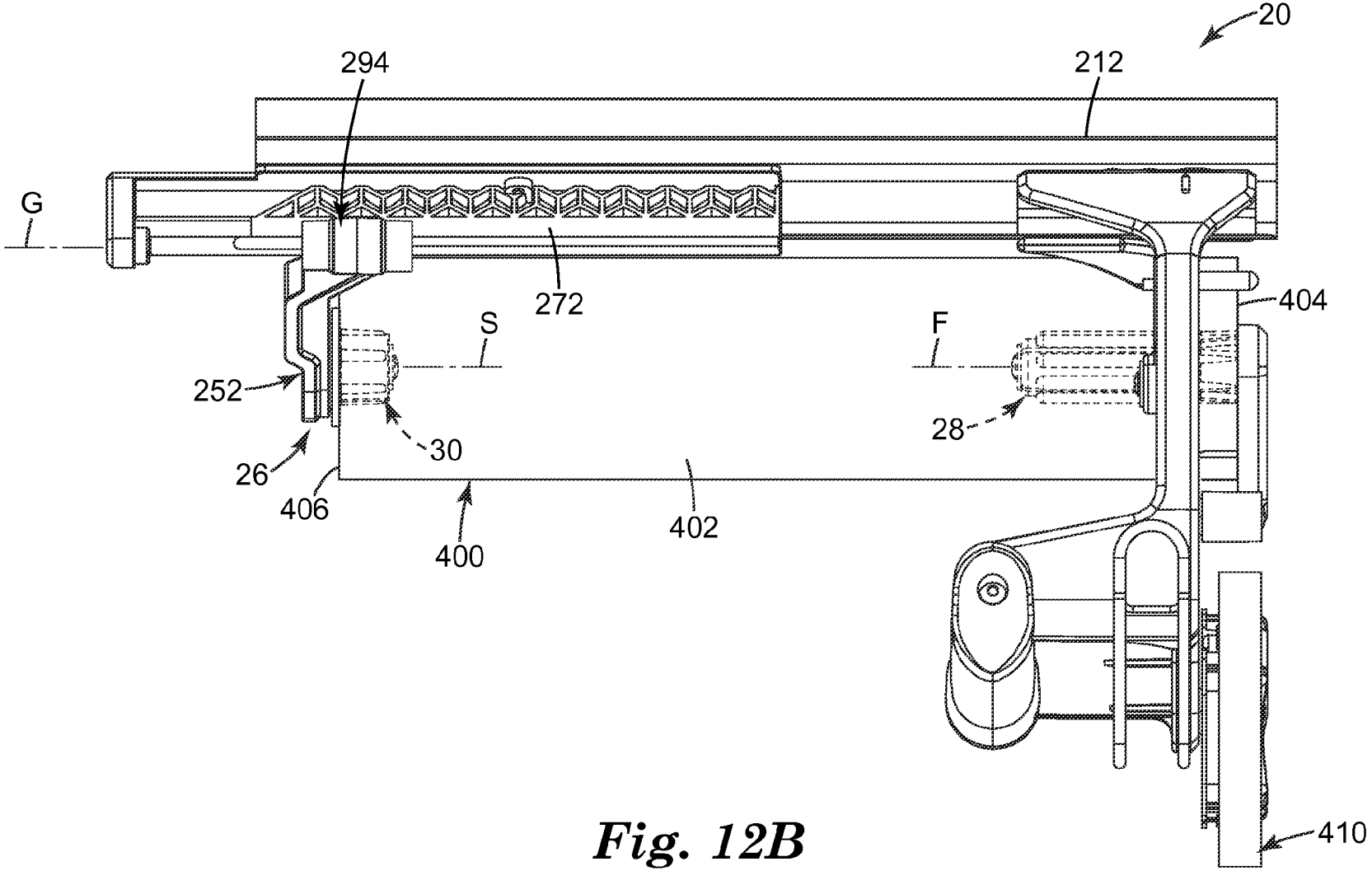

The support hub 30 is then loaded into the roll second end 406 as shown in FIG. 12B. For example, with the brace 252 in the unlocked state, the brace 252 is rotated about the guide axis G to bring the support hub 30 into substantial alignment with the film axis F, and thus into substantial alignment with the roll second end 406. The brace 252 is moved longitudinally toward the roll second end 406, including the collar 294 sliding into interface with the first track segment 272. In this regard, the keyed relationship provided by the support assembly 26 along the first track segment 272 as described above ensures that as the collar 294 is slid over the first track segment 272, the brace 252, and thus the support hub 30, is spatially locked in substantial alignment with the film hub 28, and thus with the roll second end 406. The brace 252 can be moved to any longitudinal position (relative to the film hub 28) that is otherwise commensurate with a width of the roll 400. Once engaged by the support hub 30, both ends 404, 406 of the roll 400 of the masking sheet material 402 are spatially fixed relative to the cutting edge 212 (referenced generally) via the film hub 28 and the support hub 30, respectively.

Figure 12C:
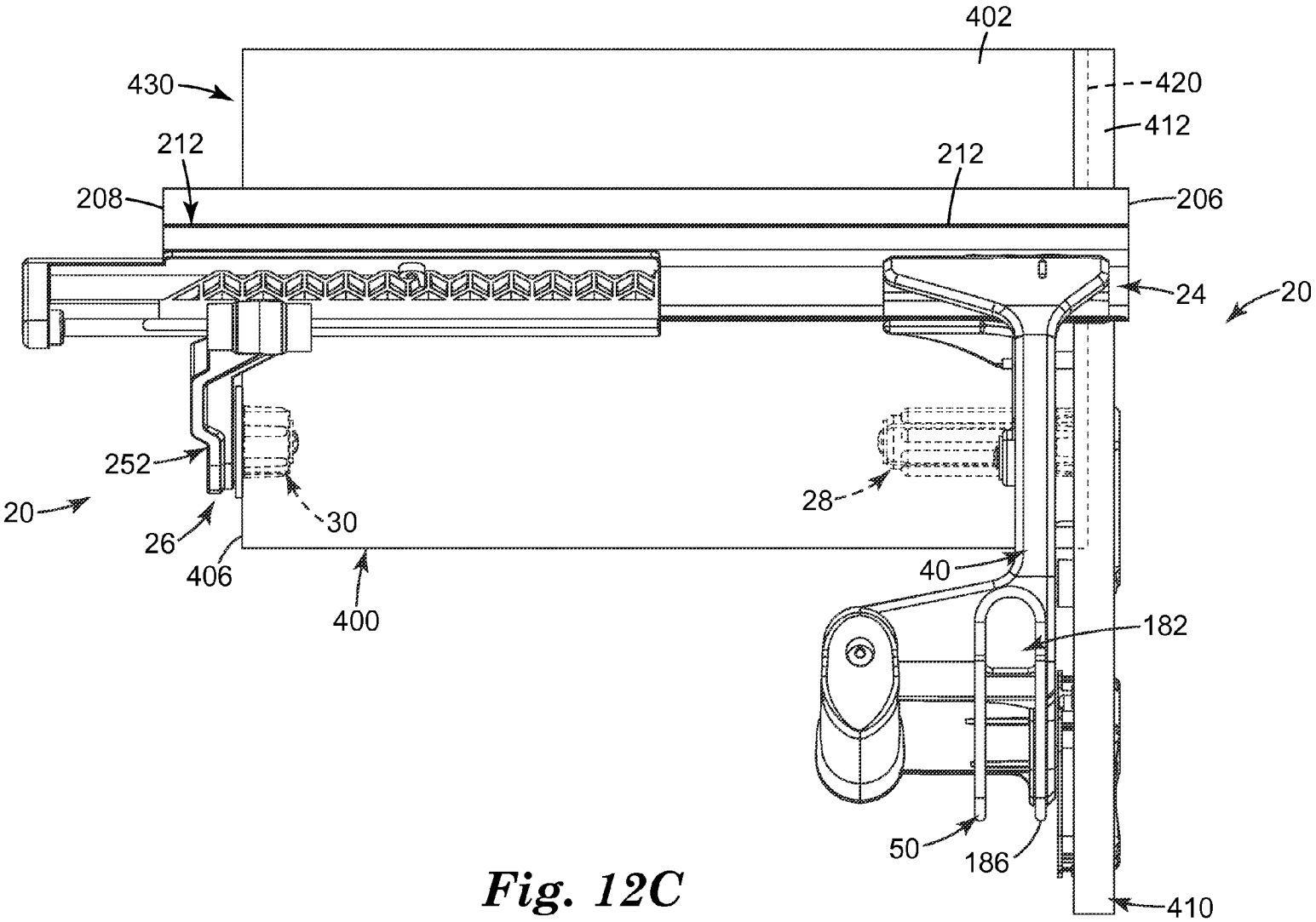

As shown in FIG. 12C, the dispenser 20 defines a film path for the masking sheet material 402 from the roll 400 and a tape path for the adhesive tape 412 from the roll 410 by which a portion of the adhesive tape 412 overlies, and is adhered to, an edge 420 of the masking sheet material 402. Such adhesion of the adhesive tape 412 to the masking sheet material 402 forms a composite masking sheet material 430 having opposing edges defined by an edge of the adhesive tape 412 and an edge of the masking sheet material 402. An underside of the adhesive tape 412 beyond the edge 420 of the masking sheet material 402 carries an exposed adhesive (not shown) that can be adhered to a surface to be masked to hold the composite masking sheet material 430 in a desired position.

A length of the composite masking sheet material 430 can be dispensed from the dispenser 20 by pulling the composite masking sheet material 430 away from the dispenser 20 and/or adhering the composite masking sheet material 430 to a surface and then moving the dispenser 20 away from the adhered portion. Regardless, one a desired length of the composite masking sheet material 430 has been dispensed, a user of the dispenser 20 can manipulate the dispenser 20 to manually tension the composite masking sheet material 430 being pulled from the rolls 400, 410 about the cutting edge 212 (referenced generally) to sever the composite masking sheet material 430. Severing along the cutting edge 212 will initiate at the blade first end 206 (i.e., proximate the roll first end 404) and progresses to the blade second end 208. Due to the applied tension, the elongated blade 24 (referenced generally) may flex or deflect during this progressive cutting action. However, because the roll second end 406 is affixed relative to the blade second end 208, any spatial deflection of the elongated blade 24 will be transferred to the roll second end 406 via the brace 252 such that the roll 400 effectively mimics "movement" or deflection of the elongated blade 24. Thus, the cut edge formed in the composite masking sheet material 430 will be substantially straight. In some embodiments, the support hub 30 optionally can be a tension roller to balance and slightly increase the unwind tension. Where provided, the slightly higher unwind tension can also help to reduce the requisite cutting force and tearing along the cutting edge 212. For example, a Teflon washer or other tension-generating components can be assembled to the support hub 30. In some embodiments, tension on the support hub 30 is akin to tension at the film hub 28.

When a user desires to replace the roll 400 of masking sheet material 402, the brace 252 is slid away from the roll second end 406, dislodging the support hub 30 from the roll 400. If necessary, the brace 252 can be manipulated to the unlocked state as described above, allowing a user to readily remove the roll 400 from the film hub 28. A new roll of masking sheet material can then be loaded to the dispenser commensurate with the above descriptions.

In between applications of the composite masking sheet material 430 or other periods of non-use, the dispenser 20 can conveniently be connected to clothing (or other article) worn or carried by the user, such as the user's back pocket. For example, with embodiments including the optional pocket clip 50, the dispenser 20 is manipulated to place an edge of the clothing (or other article) within the clip passage 182, resting the clothing edge against the closed end 186 of the pocket clip 50. Because an axis of the passage 182 is substantially perpendicular to the cutting edge 212 and is arranged at an upper side of the frame 40, when connected to the user's back pocket in this fashion, the cutting edge 212 will naturally face away from the user.

Retrofitted Assembly

Returning to FIGS. 1A and 1B, while some aspects of the present disclosure are described as entailing a complete dispenser, other aspects of the present disclosure relate to the support assembly 26 in isolation. The support assembly 26 can be mounted or retrofitted to any existing composite sheet material dispenser having a conventional J-shaped elongated blade by simply attaching the bracket 250 to the existing blade. In related embodiments, the support assemblies of the present disclosure can further include the guard 200 that is also mounted or retrofitted to an existing composite sheet material dispenser blade. In yet other embodiments of the present disclosure, the elongated blade 24, the support assembly 26 and the guard 200 are assembled to one another and then mounted or retrofitted to the handle assembly of an existing composite sheet material dispenser (i.e., replacing the blade of the existing composite sheet material dispenser).

Although specific embodiments of the present disclosure have been shown and described herein, it is understood that these embodiments are merely illustrative of the many possible specific arrangements that can be devised in application of the principles of the present disclosure. Numerous and varied other arrangements can be devised in accordance with these principles by those of ordinary skill in the art without departing from the spirit and scope of the present disclosure. Thus, the scope of the present disclosure should not be limited to the structures described in this application, but only by the structures described by the language of the claims and the equivalents of those structures. For example, while dispensers of the present disclosure have been described as including a tape hub, in other embodiments the tape hub can be omitted (e.g., with sheet material dispensing end-use applications that do not entail an adhesive tape or that provide the composite sheet material in a single roll).

What is claimed is:

1. A hand held dispenser for dispensing lengths of sheet material from a roll of sheet material, the roll of sheet material having opposing, first and second roll ends, the dispenser comprising:

a handle assembly including:

a frame, a hub for selectively receiving the first roll end, the hub rotatably mounted to the frame such that the hub is rotatable about a hub axis;

an elongated blade attached to and extending from the frame, the elongated blade having a cutting edge extending between opposing, first and second blade ends, wherein the first blade end is proximate the frame and the second blade end is opposite the frame; and a support assembly including:

a bracket attached to the elongated blade apart from the frame, the bracket including a guide track having first and second segments combining to define a guide axis, a brace defining a leading side opposite a trailing side, the leading side slidably mounted to the guide track such that the brace is slidable relative to the elongated blade along the guide axis, a support hub for selectively receiving the second roll end, the support hub rotatably mounted to the trailing side of the brace;

wherein the dispenser is configured to provide:

a locked state in which the leading side of the brace is over the first segment of the guide track and is prevented from rotating relative to the bracket, an unlocked state in which the leading side of the brace is over the second segment of the guide track and can rotate relative to the bracket.

2. The dispenser of claim 1, wherein the cutting edge is spaced from and substantially parallel to the hub axis.

3. The dispenser of claim 1, wherein the guide axis is spaced from and substantially parallel to the hub axis.

4. The dispenser of claim 1, wherein support hub is rotatable about a support axis, and further wherein the locked state includes the support axis substantially aligned with the hub axis.

5. The dispenser of claim 1, wherein the unlocked state includes the brace being rotatable relative to the bracket about the guide axis.

6. The dispenser of claim 1, wherein the leading end of the brace is longitudinally slidable along the guide track in both the locked and unlocked states.

7. The dispenser of claim 1, wherein guide track and the leading side of the brace combine to form a mated keying arrangement along the first segment, the keying arrangement including:

a slot formed in one of the leading side and the first segment; and a tab formed by an other the leading side and the first segment;

wherein the slot is configured to slidably receive the tab.

8. The dispenser of claim 7, wherein the slot is provided by the leading side and the tab is provided by the guide track.

9. The dispenser of claim 8, wherein the leading side includes a collar forming a central passage sized to receive the guide track, the slot being formed in the collar and open to the central passage.

10. The dispenser of claim 7, wherein the guide track includes a main track body, and further wherein the tab projects from the main track body along only the first segment.

11. The dispenser of claim 1, wherein the second segment of the guide track extends from the first segment in a direction opposite the frame.

12. The dispenser of claim 1, wherein the guide track extends between opposing, first and second track ends, the first track end being more proximate the frame than the second track end, and wherein the support assembly further includes:

a shoe assembled to the second track end and configured to prevent sliding movement of the first side of the brace beyond the second track end.

13. The dispenser of claim 1, wherein the guide track extends between opposing, first and second track ends, the first track end being more proximate the frame than the second track end, and further wherein the second track end is longitudinally beyond the second blade end in a direction of the hub axis.

14. The dispenser of claim 1, wherein the frame includes:

a panel, wherein the hub projects from the side panel; and opposing arms extending from the side panel in a direction of extension of the hub;

wherein the handle assembly further includes a grip attached to the opposing arms opposite the side panel.

15. The dispenser of claim 14, wherein the grip includes:

a rigid inner rigid post attached to the opposing arms; and a soft gripping member disposed over the inner post.

16. The dispenser of claim 1, further including:

a tape hub mounted to the frame, the tape hub including:

a tape hub body defining an outer surface configured to frictionally retain a core of a tape roll, the tape hub body being rotatably mounted relative to the frame;

a metal spring clip associated with the tape hub body and including a spring arm biased outwardly beyond the outer surface.

17. The dispenser of claim 1, further including a pocket clip coupled to the frame, wherein the pocket clip defines an open end opposite a closed end and a clip axis extending between the open and closed ends, and further wherein the clip axis is substantially perpendicular to the cutting edge.

18. A support assembly for use with a hand held dispenser for dispensing a length of sheet material from a roll of sheet material, the dispenser including a handle assembly and an elongated blade, the handle assembly include a frame and a hub rotatably mounted to the frame such that the hub is rotatable about a hub axis, wherein the elongated blade is attached to and extends from the frame, the support assembly comprising:

a bracket configured for selective attachment to the elongated blade apart from the frame, the bracket including a guide track having first and second segments combining to define a guide axis;

a brace defining a leading side opposite a trailing side, the leading side slidably mounted to the guide track such that the brace is slidable relative to the bracket along the guide axis, a support hub for selectively receiving an end of a roll of sheet material, the support hub rotatably mounted to the trailing side of the brace;

wherein the support assembly is configured to provide:

a locked state in which the leading side of the brace is over the first segment of the guide track and is prevented from rotating relative to the bracket, an unlocked state in which the leading side of the brace is over the second segment of the guide track and can rotate relative to the bracket.

19. A method of applying a length of sheet material to a surface, the method comprising:

receiving a hand held dispenser including:

a handle assembly including:

a frame, a hub rotatably mounted to the frame such that the hub is rotatable about a hub axis, an elongated blade attached to and extending from the frame, the elongated blade having a cutting edge extending between opposing, first and second blade ends, wherein the first blade end is proximate the frame and the second blade end is opposite the frame; and a support assembly including:

a bracket attached to the elongated blade apart from the frame, the bracket including a guide track having first and second segments combining to define a guide axis, a brace defining a leading side opposite a trailing side, the leading side slidably mounted to the guide track such that the brace is slidable relative to the elongated blade along the guide axis, a support hub rotatably mounted to the trailing side of the brace;

sliding the brace along the guide track in a direction away from the hub and to an unlocked state;

rotating the brace relative to the guide track in the unlocked state such that the support hub is not aligned with the hub axis;

receiving a roll of sheet material, the roll defining opposing, first and second ends;

loading the first end on to the hub;

rotating the brace relative to the guide track to align the support hub with the hub axis;

sliding the brace along the guide track in a direction toward the hub to a locked state in which the second end is loaded on to the support hub;

manipulating the dispenser relative to the surface such that a length of sheet material is progressively dispensed from the dispenser; and manipulating the dispenser to sever the length of sheet material from the roll of sheet material via the cutting edge.

* * * * *